US009267348B2

(12) United States Patent
Ingram et al.

(10) Patent No.: US 9,267,348 B2
(45) Date of Patent: Feb. 23, 2016

(54) METHOD AND APPARATUS FOR ISOLATING AND TREATING DISCRETE ZONES WITHIN A WELLBORE

(75) Inventors: Gary D. Ingram, Richmond, TX (US); William D. Friend, Jr., Cypress, TX (US); Walter Stone Thomas Fagley, IV, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 940 days.

(21) Appl. No.: 13/274,119

(22) Filed: Oct. 14, 2011

(65) Prior Publication Data

US 2012/0090858 A1 Apr. 19, 2012

Related U.S. Application Data

(60) Provisional application No. 61/393,748, filed on Oct. 15, 2010.

(51) Int. Cl.
*E21B 23/06* (2006.01)
*E21B 33/128* (2006.01)
*E21B 43/26* (2006.01)

(52) U.S. Cl.
CPC ..... *E21B 23/06* (2013.01); *E21B 33/128* (2013.01); *E21B 43/26* (2013.01)

(58) Field of Classification Search
CPC ..... E21B 33/12; E21B 33/1208; E21B 23/06; E21B 34/14; E21B 33/128; E21B 23/01; E21B 33/122
See application file for complete search history.

(56) References Cited

U.S. PATENT DOCUMENTS

| | | | |
|---|---|---|---|
| 4,485,876 | A | 12/1984 | Speller |
| 4,605,062 | A | 8/1986 | Klumpyan et al. |
| 5,782,306 | A | 7/1998 | Serafin |
| 6,253,856 | B1 | 7/2001 | Ingram et al. |
| 6,257,339 | B1 | 7/2001 | Haugen et al. |
| 6,581,455 | B1 | 6/2003 | Berger et al. |
| 6,655,461 | B2 | 12/2003 | Eslinger et al. |
| 6,695,057 | B2 | 2/2004 | Ingram et al. |
| 6,782,954 | B2 | 8/2004 | Serafin et al. |

(Continued)

FOREIGN PATENT DOCUMENTS

GB 2384257 A 7/2003

OTHER PUBLICATIONS

PCT International Search Report and Written Opinion; PCT International Application No. PCT/US2011/056452; Mailed Mar. 25, 2013.

(Continued)

*Primary Examiner* — Jennifer H Gay
*Assistant Examiner* — Caroline Butcher
(74) *Attorney, Agent, or Firm* — Patterson & Sheridan, LLP

(57) ABSTRACT

Methods and apparatus for conducting fracturing operations using a wellbore fracturing assembly are described. The assembly may be mechanically set and released from a wellbore using a coiled tubing string. The assembly may include a pair of spaced apart packers for straddling the area of interest, an injection port disposed between the packers for injecting fracturing fluid into the area of interest, and an anchor for securing the assembly in the wellbore. At least one of the packers includes a pressure balanced mandrel. After conducting the fracturing operation, the assembly may be relocated to another area of interest to conduct another fracturing operation.

38 Claims, 15 Drawing Sheets

(56) References Cited

U.S. PATENT DOCUMENTS

| | | | |
|---|---|---|---|
| 6,823,945 | B2 | 11/2004 | Eslinger et al. |
| 6,832,654 | B2 | 12/2004 | Ravensbergen et al. |
| 6,883,610 | B2 | 4/2005 | Depiak |
| 7,011,157 | B2 | 3/2006 | Costley et al. |
| 7,032,675 | B2 | 4/2006 | Steele et al. |
| 7,051,812 | B2 | 5/2006 | McKee et al. |
| 7,472,746 | B2 | 1/2009 | Maier |
| 7,478,676 | B2 | 1/2009 | East, Jr. et al. |
| 7,484,565 | B2 | 2/2009 | van Batenburg et al. |
| 2002/0125005 | A1 | 9/2002 | Eslinger et al. |
| 2002/0195248 | A1 | 12/2002 | Ingram et al. |
| 2004/0129421 | A1 | 7/2004 | Hoffman et al. |
| 2006/0213656 | A1 | 9/2006 | Clifton |
| 2007/0068676 | A1 | 3/2007 | Shkurti |
| 2009/0056956 | A1 * | 3/2009 | Ingram ..... 166/387 |
| 2010/0243254 | A1 | 9/2010 | Murphy et al. |

OTHER PUBLICATIONS

RoboPacker—New Solution for Coiled Tubing Fracturing and Other Applications Requiring Zonal Isolation, Depiak Industrial Technology, Product Report, Jun. 2005.

Austrailian Exam Report for Patent Application No. 2011315828 dated Dec. 1, 2014.

PCT Preliminary Report on Patentability for International Application No. PCT/US2011/056452 dated Apr. 25, 2013.

EP Office Action for Application No. 11 776 975.2-1610 dated May 5, 2015.

* cited by examiner

METHOD AND APPARATUS FOR ISOLATING AND TREATING DISCRETE ZONES WITHIN A WELLBORE

CROSS-REFERENCE TO RELATED APPLICATIONS

This application claims benefit of U.S. Provisional Patent Application No. 61/393,748, filed Oct. 15, 2010, which application is incorporated herein by reference in its entirety.

BACKGROUND OF THE INVENTION

1. Field of the Invention

Embodiments of the present invention relate to a mechanically set packer suitable for use to isolate a zone in a wellbore. In one embodiment, the packer includes a pressure balanced mandrel to facilitate release of the packer. In another embodiment, the packer includes a pressure balanced mandrel to prevent application of excessive hydraulic force on the packing element. In yet another embodiment, the present invention relates to an assembly of packers for isolating a zone within a wellbore.

2. Description of the Related Art

In certain wellbore operations, it is desirable to "straddle" an area of interest in a wellbore, such as an oil formation, by packing off the wellbore above and below the area of interest. A sealed interface is set above the area of interest and another sealed interface is set below the area of interest. Typically the area of interest undergoes a treatment, such as fracturing, to assist the recovery of hydrocarbons from the straddled formation.

A variety of straddling tools are available, the most common being a cup-type tool. These tools are effective at shallow depths but may have maximum depth limitations at around 6,000 feet due to the swabbing effect induced on the wellbore liner by the tool coming out of the hole. Another type of tool includes hydraulically actuated packers disposed above and below an area of interest. However, this hydraulically actuated tool relies on a valve to open and shut to allow a fluid back pressure to set the packers, which is susceptible to flow cutting during pumping operations.

There is a need, therefore, for a mechanically actuated packer having a pressure balanced mandrel. There is also a need for a mechanically actuated packer whose actuation or de-actuation is not affected by the fluid pressure flowing therethrough. There is a further need for a wellbore isolation assembly equipped with a tension actuated packer having a pressure balanced mandrel.

SUMMARY OF THE INVENTION

Embodiments of the invention generally relate to methods for conducting wellbore treatment operations and apparatus for a wellbore treatment assembly.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The invention generally relates to an apparatus and method for conducting wellbore treatment operations. As set forth herein, the invention will be described as it relates to a wellbore fracturing operation. It is to be noted, however, that aspects of the invention are not limited to use with a wellbore fracturing operation, but are equally applicable to use with other types of wellbore treatment operations, such as acidizing, water shut-off, etc. To better understand the novelty of the apparatus of the invention and the methods of use thereof, reference is hereafter made to the accompanying drawings.

Figure 1:
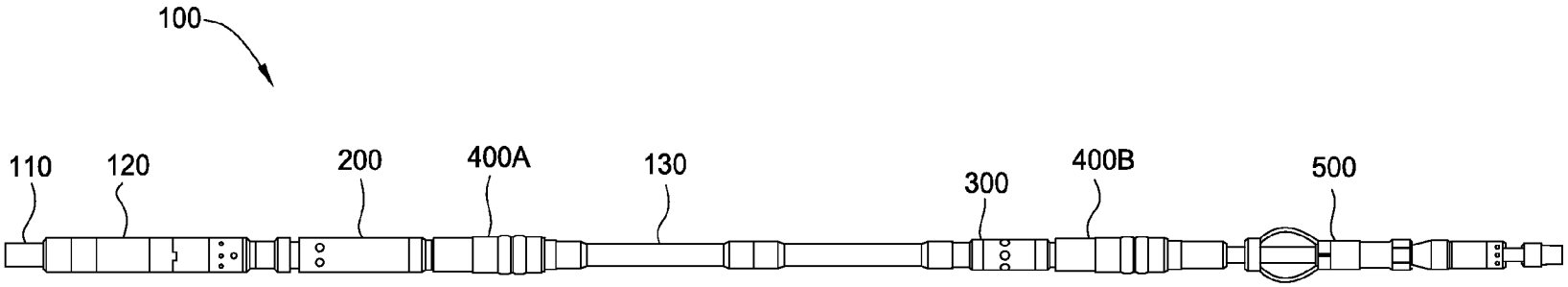
FIG. 1 illustrates a side view of a wellbore treatment assembly according to one embodiment of the invention.

FIG. 1 is a side view of a wellbore fracturing assembly 100 according to one embodiment of the invention. In general, the assembly 100 is lowered into a wellbore on a coiled tubing string 110 at a desired location. Other types of tubular or work strings having tubing or casing may also be used with the assembly 100. To "straddle" or sealingly isolate an area of interest in a formation, the assembly 100 is mechanically set in the wellbore by pulling and pushing on the coiled tubing string 110, thereby placing the assembly 100 in tension and securing the assembly 100 in wellbore and straddling the area of interest. After the assembly 100 is set in the wellbore, a fracturing operation may be conducted through the assembly 100 and directed to the isolated area to fracture the area of interest and recover hydrocarbons from the formation. Upon completion of the fracturing operation, the assembly 100 is mechanically unset from the wellbore by pulling and pushing on the coiled tubing string 100 to release the tension, thereby unstraddling the area of interest and releasing the assembly 100 from the wellbore. The assembly 100 may then be relocated to another area of interest in the formation and re-set to conduct another fracturing operation. As described herein with respect to unsetting the assembly 100, the application of one or more mechanical forces to achieve the unsetting sequence may be accomplished merely by releasing the tension which had been applied to set the assembly 100 in place initially, or may be supplemented by additional force applied by springs within the components and/or by setting weight down on the assembly 100.

As illustrated, the assembly 100 may include an adapter sub 120, an unloader 200, packers 400A and 400B, an injection port 300 disposed between the packers 400A and 400B, and an anchor 500. The assembly 100 may also include one or more spacer pipes 130 disposed between packers 400A and 400B to adjust the straddling length of the assembly 100 depending on the size of the area of interest in the formation to be isolated and/or fractured. In one embodiment, the adapter sub 120 is coupled at its upper end to the tubing string 110 and is coupled at its lower end to the unloader 200. The lower end of the unloader 200 is coupled to the upper end of the packer 400A, which is coupled to the spacer pipe 130. The injection port 300 is coupled to spacer pipe 130 at one end and is coupled to the packer 400B at its opposite end. Finally, the anchor 500 is located at the bottom end of the assembly 100, specifically the anchor 500 is coupled to the lower end of the packer 400B.

In operation, the assembly 100 is lowered on the tubing string 110 into the wellbore adjacent the area of interest in the formation for conducting a fracturing operation. Once the assembly 100 is positioned in the wellbore, the assembly may be raised and lowered to create an "up and down" motion by pulling and pushing on the tubing string 110 to actuate and set the anchor 500. After the anchor 500 is set and the assembly 100 is secured in the wellbore, tension is further applied to the assembly 100 by pulling on the tubing string 110. The tension in the assembly 100 is utilized to actuate and set the packers 400A and 400B to straddle the area of interest in the formation. The tension in the assembly 100 is also utilized to set the unloader 200 into a closed position to prevent fluid communication between the unloader 200 and the annulus surrounding the assembly 100. The assembly 100 is then held in tension to conduct the fracturing operation.

A fracturing and/or treating fluid, including but not limited to water, chemicals, gels, polymers, or combinations thereof, and further including proppants, acidizers, etc., may be introduced under pressure through the tubing string 110, the adapter sub 120, the unloader 200, the packer 400A, and the spacer pipe 130, and injected out through the injection port 300 into the area of interest of the formation between the packers 400A and 400B. In one embodiment, the assembly 100 may include more than one injection port 300 to facilitate the fracturing operation by reducing the velocity of flow through the injection port 300. In one embodiment, the wellbore and/or wellbore casing or lining may have been perforated adjacent the area of interest to facilitate recovery of hydrocarbons from the formation.

In one embodiment, a device, such as a plug or a check valve, may be located below the assembly 100 to prevent the fracturing and/or treating fluid from flowing through the bottom end of the assembly 100 and to allow pressure to build within the assembly 100 and the area of interest in the formation between the packers 400A and 400B during the fracturing operation. In one embodiment, a device, such as a circulation sub (not shown), may be located above the assembly 100 or the packer 400A. The circulation sub may initially allow a two-way fluid communication flow between the assembly 100 and the wellbore surrounding the assembly 100 as the assembly 100 is located in the wellbore. A ball or dart may subsequently be introduced into the circulation sub to prevent fluid flow from the internal throughbore of the assembly 100 to the wellbore surrounding the assembly 100 but allow fluid flow from the wellbore surrounding the assembly 100 to the throughbore of the assembly 100, to permit a fracturing operation.

In one embodiment, one or more seats (not shown) may be located in series within the assembly 100, below the injection port 300, which are configured to receive a ball or dart to close fluid communication through the throughbore of the assembly 100 to permit a fracturing operation. Upon completion of the fracturing operation, the pressure within the assembly 100 may be increased to an amount such that the ball, dart, and/or the seat are extruded through assembly 100 or displaced within the throughbore of the assembly 100 to open fluid communication through the throughbore of the assembly 100 below the injection port 300 to the wellbore surrounding the assembly 100. This open fluid communication may also help equalize the pressure differential across the lower packer 400B to assist unsetting of the packer 400B. The assembly 100 may then be moved to another location in the wellbore and/or another ball or dart may then be introduced on another seat to conduct another fracturing operation. In an alternative embodiment, the one or more seats may be collets that are operable to receive the ball or dart to close fluid communication within the assembly 100 and that are shearable to subsequently allow the ball or dart to be moved to open fluid communication within the assembly 100.

In one embodiment, a device, such as an overpressure valve (not shown), may be located below the assembly 100 to assist in the fracturing operation. The overpressure valve may be actuated, biased, or preset to close fluid communication between the assembly 100 and the wellbore, below the packer 400B, thereby allowing pressure to build in the work string below the injection port 300 and preventing fluid from continuously flowing through the remainder of the work string. Upon completion of the fracturing operation, the pressure within the assembly 100 may be increased to a pressure that temporarily actuates the overpressure valve into an open position to release the pressure within the assembly 100 and to open fluid communication between the assembly 100 and the wellbore surrounding the assembly 100 below the packer 400B. This pressure release may also help equalize the pressure differential across the packer 400B to help facilitate unsetting of the packer 400B. As the pressure drops within the assembly 100, the overpressure valve may then be actuated or biased into a closed position, thereby closing fluid communication between the assembly 100 and the wellbore below the packer 400B.

After the fracturing operation is complete, the tension in the tubing string 110 and the assembly 100 is released, which may be facilitated by pushing on the tubing string 110. The tension release allows the unloader 200 to actuate into an open position to permit fluid communication between the unloader 200 and the annulus surrounding the assembly 100 to equalize the pressure above and below the packer 400A to help unsetting of the packer 400A. The tension release also allows the packers 400A and 400B and the anchor 500 to unset from engagement with the wellbore. The assembly 100 may then be removed from the wellbore. Alternatively, the assembly 100 may be relocated to another area of interest in the formation to conduct another fracturing operation.

In one embodiment, the assembly 100 may include only one packer 400A or 400B that is utilized to conduct the wellbore treatment operation. The packer 400A or 400B may be used to isolate the area of interest by sealing the wellbore either above or below the area of interest. The packer 400A or 400B may be operated as described herein.

In one embodiment, the assembly 100 may include measurement tools to determine various wellbore characteristics. Such measurement tools may include as temperature gages and sensors, pressure gages and sensors, flow meters, and logging devices (e.g. a logging device used to measure the emission of gamma rays from the formation). The assembly 100 may also include power and memory sources to control and communicate with the measurement tools.

The assembly 100 may optionally include the adapter sub 120. The adapter sub 120 may function as a releasable connection point between the tubing string 110 and the rest of the assembly 100 in case of an emergency that requires a quick removal of the tubing string 110 from the wellbore or another event, such as the assembly 100 getting wedged in the wellbore, to allow removal of the tubing string 110 and to allow a retrieval operation. In addition, the adapter sub 120 may operate as a control valve, such as a check valve, to help control the flow of fluid supplied to the assembly 100 to conduct the fracturing operation.

The unloader 200 is operable to open and close fluid communication between the tubing string 110 and the annulus of the wellbore surrounding the assembly 100. When the assembly 100 is being located and secured in the wellbore, and when the assembly 100 is being tensioned by pulling on the tubing string 110, the unloader 200 may be actuated and maintained in a closed position. The unloader 200 may then be actuated into an open position after the assembly 100 is released from being tensioned by the tubing string 110 and/or a downward or push force is applied to the assembly 100 via the tubing string 110. In the open position, the unloader 200 allows equalization of the pressure above and below the packer 400A to reduce the pressure differential subjected to the packer 400A during unsetting of the packer, as well as equalize the pressure internal and external to the assembly 100. This pressure equalization helps unset the packer 400A from the wellbore, so that the assembly 100 may be moved in the wellbore without damaging the packer 400A for subsequent sealing. An exemplary unloader is described in U.S. Patent Application Publication No. 2010/0243254, which description is incorporated herein by reference, including FIGS. 2A and 2B and paragraphs [0042] to [0051]. In must be noted that the inclusion of the unloader 200 in the assembly 100 is optional when the packers 400 include a pressure balanced inner mandrel, as described below. An exemplary unloader 200 is disclosed in FIGS. 7A and 7B described below.

Figure 2:
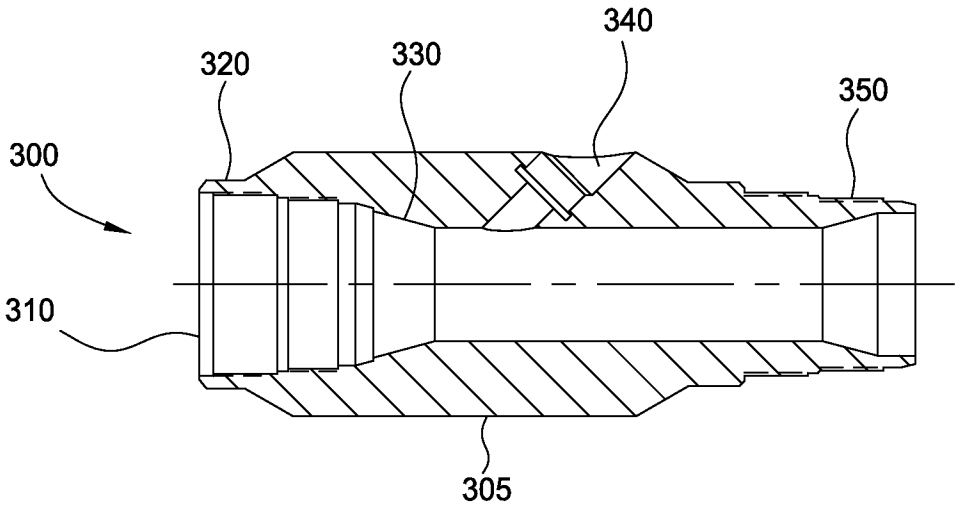
FIG. 2 illustrates a cross sectional view of an injection port according to one embodiment of the invention.

FIG. 2 illustrates the injection port 300 according to one embodiment of the invention. The injection port 300 allows fluid communication between the assembly 100 and the annulus surrounding the assembly 100 within the wellbore. The injection port 300 includes a cylindrical body 305 having a bore 310 disposed through the body 305. The inner diameter of an upper end 320 of the body 305 may be connected to the packer 400, the spacer pipe 130, and/or other downhole tool that may be included in the assembly 100. The outer diameter of a lower end 350 of the body 305 may be connected to the packer 400, the spacer pipe 130, and/or other downhole tool that may be included in the assembly 100. The bore 310 of the body 305 may include a restriction section 330 for increasing the flow rate of fluid introduced through the bore 310 of the injection port 300 prior to communication with a port 340 for injection into the annulus surrounding the injection port 300 during a fracturing operation. The bore 310 and the port 340 may be protected with an erosion resistant material such as tungsten carbide. Alternatively, the entire injection port 300 may be formed from an erosion resistant material such as tungsten carbide. In one embodiment, the injection port 300 may include removable tungsten carbide inserts located within the port 340. In one embodiment, the injection port 300 may include a plurality of ports 340.

Figure 3A:
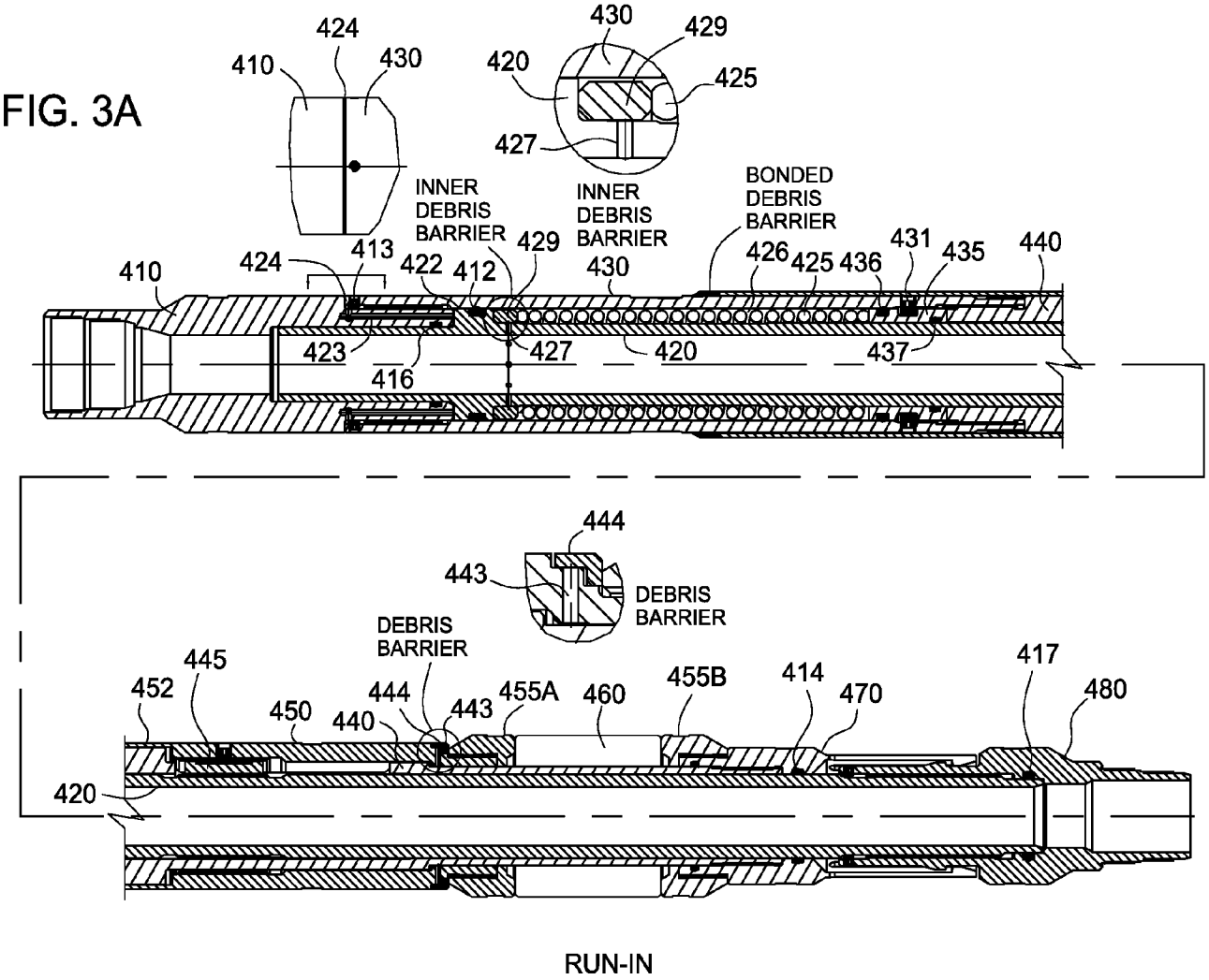
FIG. 3A illustrates a cross sectional view of a packer in an unset position according to one embodiment of the invention.

FIG. 3A illustrates the packer 400 in an unset position according to one embodiment of the invention. The following description of the packer 400 relates to both the packer 400A and 400B as shown in FIG. 1. The packers 400A and 400B are substantially similar in operation and are positioned in tandem within the assembly 100 so that they may be simultaneously actuated, or alternatively, one packer may be set and/or unset prior to the other packer. The packers 400A and 400B may be configured as part of the assembly 100 to be selectively actuated by an upward or pull force that induces tension in the assembly 100, via the tubing string 110 for example. The packers 400A and 400B are operable, for example, to straddle or sealingly isolate an area of interest in a formation for conducting a fracturing operation to recover hydrocarbons from the formation.

The packer 400 includes a top sub 410, an inner mandrel 420, an upper housing 430, a spring mandrel 440, a lower housing 450, a packing element 460, a latch sub 470, and a bottom sub 480. The top sub 410 includes a cylindrical body having a bore disposed through the body. The upper end of the top sub 410 may be configured to connect to the unloader 200 or other downhole tool of the assembly 100. The lower end of the top sub 410 is coupled to the upper end of the upper housing 430. The top sub 410 and upper housing 430 interface may be secured together using, for example, a set screw 413. The inner diameter of the top sub 410 is configured to receive the upper end of the inner mandrel 420.

The inner mandrel 420 is movably coupled to the top sub 410 and the upper housing 430. The inner mandrel 420 extends from the top sub 410 to the bottom sub 480. The inner mandrel 420 has an upper end coupled to an inner recess of the top sub 410. A seal 416, such as an o-ring is disposed between the top sub 410 and the inner mandrel 420. A flange 422 on an outer surface of the inner mandrel 420 is configured to abut the lower end of the top sub 410 and to contact the upper housing 430. A seal 412, such as an o-ring, may be provided between the upper housing 430 and inner mandrel 420 interface. A fluid channel 423 is provided in the top sub 410 to supply fluid from the annulus into a space formed between the lower end of the top sub 410 and the flange 422, when the inner mandrel 420 is moved away from the top sub 410. In one exemplary embodiment, fluid from the annulus may flow through a clearance 424 defined by the interface between the upper end of the upper housing 430 and the top sub 410 before entering the fluid channel 423. The size of the clearance 424 may be controlled such that it may act as a debris barrier. For example, the size of the clearance 424 may be set to be smaller than the size of proppant (e.g., 20/40 proppant) used in a fracturing application.

The upper housing 430 includes a cylindrical body having a bore therethrough and surrounds the upper portion of the inner mandrel 420. A biasing member 425 is disposed in a chamber 426 between the upper housing 430 and the inner mandrel 420. The biasing member 425 may be a spring that abuts the flange 422 on the outer diameter of the upper end of the inner mandrel 420 at one end and abuts the upper end of a retainer 435 at the other end, thereby biasing the inner mandrel 420 against the bottom end of the top sub 410. The biasing member 425 may be used to facilitate unsetting of the packing element 460. The retainer 435 includes a cylindrical body and is disposed between the upper housing 430 and the inner mandrel 420. The retainer 435 is coupled to the upper housing 430 by a set screw 431. Seals 436, 437 may be positioned at the inner and outer surfaces of the retainer 435. Seals 436, 437, and 412 isolate the chamber 426 from fluid communication. In an alternative embodiment, the retainer 435 may be integral with the upper housing 430 in the form of a shoulder, for example, on the upper housing 430 against which the biasing member 425 abuts. The lower end of the upper housing 430 is coupled to the spring mandrel 440. The inner diameter of the lower end of the upper housing 430 may be coupled to the outer diameter of the upper end of the spring mandrel 440 such that the upper end of the spring mandrel abuts the retainer 435.

One or more ports 427 are formed in the inner mandrel 420 for fluid communication between the chamber 426 and the bore of the inner mandrel 420. Pressure in the tubing may enter the chamber 426 and act on the flange 422, thereby urging the inner mandrel 420 toward the top sub 410. The pressure in the tubing also acts on the upper end of the inner mandrel 420, thereby urging the inner mandrel 420 away from the top sub 410. In one embodiment, the inner mandrel 420 is configured to be pressure balanced against movement by the pressure in the tubing. In this respect, the inner mandrel 420 is configured such that the effective piston area ("Ap2" in FIG. 3B) of the flange 422 is equivalent to the effective piston area ("Ap1" in FIG. 3B) at the upper end of the inner mandrel 420. Because the opposing piston areas are equivalent, the net force acting on the inner mandrel due to the pressure in the tubing is zero. In this manner, pressure in the tubing would not negatively affect release of the packer 400 or impart additional force into the packing element or system of components retaining the pack-off force.

In one embodiment, an optional debris barrier 429 may be disposed in the chamber and over the one or more ports 427. The debris barrier 429 may be an annular body positioned between the flange 422 and the biasing member 425. The debris barrier 429 is configured such that the clearance at the interface between the ports 427 and the debris barrier 429 is controlled such that the interface may act as a barrier against proppant or other debris.

The spring mandrel 440 includes a cylindrical body having a bore disposed through the body, in which the inner mandrel 420 is provided. The lower end of the spring mandrel 440 is coupled to the latch sub 470 to facilitate actuation of the packing element 460. An inner shoulder of the latch sub 470 abuts an edge of the spring mandrel 440. The spring mandrel 440 includes longitudinal slots disposed on its outer diameter for receiving a connection member 445 that also facilitates actuation of the packing element 460. The connection member 445 is disposed on and coupled to the inner mandrel 420, and is surrounded by and further coupled to the lower housing 450. The connection member 445 may include a recess on its outer diameter for receiving a set screw disposed through the body of the lower housing 450 to axially fix the lower housing 450 relative to the inner mandrel 420. The lower housing 450 includes a cylindrical body having a bore disposed through the body, through which the inner mandrel 420 is provided. Also, the lower end of the lower housing 450 surrounds a portion of the spring mandrel 440 such that a shoulder formed on the inner diameter of the lower housing 450 abuts a shoulder formed on the outer diameter of the spring mandrel 440. A port 443 is formed in the lower housing 450 to supply fluid to the area between the lower housing 450 and the spring mandrel 440. A cap 444 may be placed over the port 443 to act as a barrier against debris. The clearance at the interface between the port 443 and the cap 444 is controlled such that the interface may act as a barrier against proppant or other debris. The upper end of the lower housing 450 includes an extension member 452 which extends over a portion of the upper housing 430. The clearance at the interface between the extension member 452 and the upper housing 430 is controlled such that the interface may act as a barrier against proppant or other debris.

As stated above, the lower end of the spring mandrel 440 may be connected to the latch sub 470, which includes a plurality of latching fingers, such as collets, that engage the outer diameter of the bottom sub 480. The packing element 460 may include an elastomer that is disposed around the spring mandrel 440 and between an upper and lower gage 455A and 455B. The gages 455A and 455B are connected to the outer diameters of the lower housing 450 and the latch sub 470, respectively, and include radially inward projecting ends that engage the ends of the packing element 460 to actuate the packing element 460. The latch sub 470 and inner mandrel 420 interface may also include a seal 414, such as an o-ring.

The bottom sub 480 includes a cylindrical body having a bore disposed through the body and is coupled to the lower end of the inner mandrel 420. The bottom sub 480 and inner mandrel 420 interface may be secured together using, for example, a set screw. The bottom sub 480 and inner mandrel 420 interface may also include a seal 417, such as an o-ring. A recessed portion on the outer diameter of the bottom sub 480 is adapted for receiving the latching fingers of the latch sub 470 to prevent premature actuation of the packing element 460. The lower end of the bottom sub 480 may be configured to be coupled to the spacer pipe 140, the anchor 500, or other downhole tool that may be included in the assembly 100.

Figure 3B:
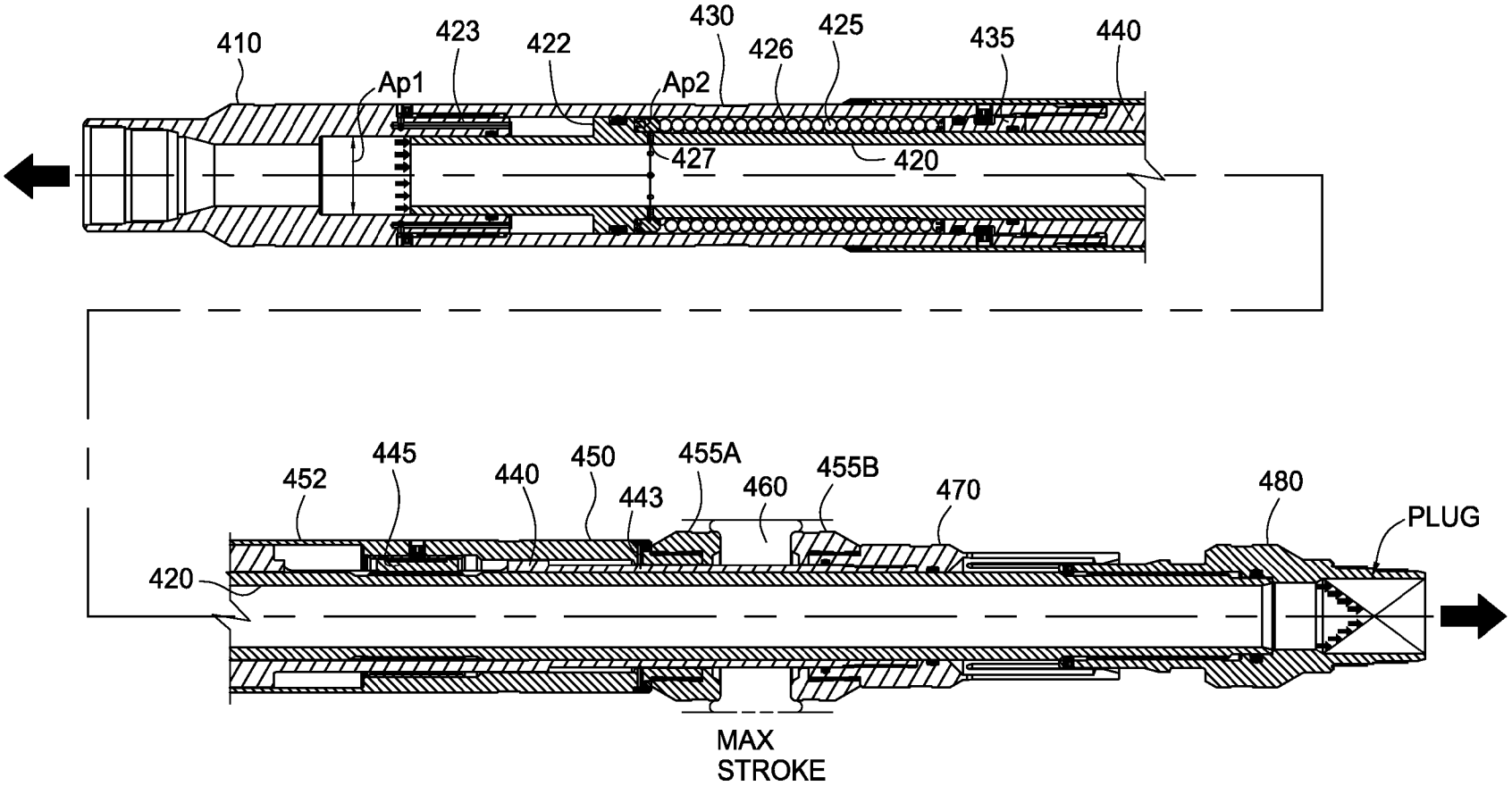
FIG. 3B illustrates a cross sectional view of the packer in a set position according to one embodiment of the invention.

FIG. 3B illustrates the packer 400 in a set position according to one embodiment of the invention. An upward or pull force applied to the assembly 100 causes the top sub 410, the upper housing 430, the retainer 435, the spring mandrel 440, and the latch sub 470 to move axially relative to the inner mandrel 420, the lower housing 450, and the bottom sub 480. Particularly, the upward force separates the top sub 410 from the inner mandrel 420, thereby compressing the biasing member 425 between the flange 422 on the inner mandrel 420 and the retainer 435. The spring mandrel 440 also separates from the lower housing 450, thereby axially moving along the outer diameter of the inner mandrel 420 and pulling on the latch sub 470. Upon the upward or pull force applied to the top sub 410, via the tubing string 110 for example, the latching fingers of the latch sub 470 disengage from the bottom sub 480 to actuate the packing element 460. The latch sub 470 and thus the lower gage 455B are axially moved toward the stationary lower housing 450 and upper gage 455A to actuate the packing element 460 disposed therebetween. The lower housing 450 is axially fixed by the anchor 500 (as will be described below) via the connection member 445, inner mandrel 420, and bottom sub 480. The packing element 460 is actuated into sealing engagement with the surrounding surface, which may be the wellbore for example. Relative movement between the components of the packer 400 causes fluid to be drawn in from the annulus to fill the increased space between the top sub 410 and the flange 422 via the fluid channel 423, the increased space between the upper end of the lower housing 450 and the spring mandrel 440 via the interface between the extension member 452 and the spring mandrel 440, and the increased space between the lower end of the lower housing 450 and the spring mandrel 440 via the port 443. Debris is substantially prevented from entering the spaces at the point of entry at each of the respective locations.

Once the packer 400 is set, fluid pressure that is introduced into the assembly 100 for the fracturing operation may act on the upper end of the inner mandrel 420 to urge it toward the packing element 460, as shown by the downward force arrows. However, the same fluid pressure is present in the chamber 426 via the ports 427 in the inner mandrel 420. The fluid pressure acts on the flange 422 (as shown by the upward force arrows) to oppose the downward force, thereby resulting in no net force on the inner mandrel 420 from the fluid pressure. In this respect, the inner mandrel 420 is pressure balanced against movement from the fluid pressure. In this manner, fluid pressure in the assembly 100 does not inhibit the release of the packer 400 or impart additional force into the packing element or system of components retaining the pack-off force.

By releasing the tension in the assembly 100 and/or pushing on the tubing string 110, the top sub 410 and thus the latch sub 470 may be retracted, with further assistance from the biasing member 425, relative to the inner mandrel 420 to unset the packing element 460.

Embodiments of the packer 400 may be used in the "up" or "down" vertical orientation. In FIGS. 3A and 3B, the packer 400 is shown in the "up" orientation, with the left side of the page being the top of the packer). However, the packer 400 may also be used in the "down" orientation, wherein orientation of the packer 400 is upside-down relative to FIGS. 3A and 3B. When used in a multiple packer assembly, one or more of the packers may be in the down orientation. For example, in a two packer, straddle type assembly, potential orientations of the packers 400A, 400B include (1) both packers in the "up" orientation; (2) packer 400A "up" and packer 400B "down" orientation; (3) packer 400A "down" and packer 400B "up" orientation; and (4) both packers down orientation. It is to be noted that because the inner mandrel 420 is pressure balanced, the fluid pressure in the packer 400 does not affect release of the packer 400 when positioned in the down orientation. In the packer 400A "up" and packer 400B "down" orientation wherein the latch sub 470 of the "down" packer 400B is located between the packing elements 460, fluid pressure in the annulus acting on the packing element 460 is transmitted through the lower housing 450, the connection member 445, and the inner mandrel 420. In this respect, the fluid pressure does not add to the load on the spring mandrel 420 when the packers are used in this orientation. As noted above, when both packers 400 include pressure balanced inner mandrels, inclusion of the unloader 200 in the assembly 100 becomes optional. In another embodiment, one of the packers may be selected from other mechanically set or hydraulic set packers. For example, a hydraulic set packer may be paired with a packer 400 having a pressure balanced inner mandrel. The packer 400 may be positioned in either the "up" or "down" orientation. An exemplary hydraulic set packer is disclosed in U.S. Pat. No. 6,253,856 to Ingram, et al. which patent is incorporate herein by reference in its entirety. An exemplary mechanically set packer is disclosed in U.S. Patent Application Publication No. 2010/0243254, which application is incorporated herein by reference, including FIGS. 3A and 3B and paragraphs [0052] to [0058]. An exemplary packer suitable for pairing with packer 400 is disclosed in FIGS. 6A and 6B described below.

During operation, the packers 400A, 400B may be simultaneously actuated or in sequence. For example, to actuate the packers 400A, 400B in sequence, the upper packer 400A may be configured with a biasing member 425 that has a higher biasing force than the biasing member of the lower packer 400B. In this respect, the lower packer 400B may be actuated first. In another embodiment, the latching fingers of the latching sub 470 may be configured to require a higher release force to disengage from the bottom sub 480, such that the lower packer 400B would actuated first. In one example, the outer diameter of the bottom sub 480 and/or the latching fingers are designed with different engagement angles in order to adjust the release force. If a hydraulic actuated packer is paired with a tension set packer 400, then the tension set packer 400 may be actuated first if it is located below the hydraulic packer. If the tension set packer 400 is located above the hydraulic set packer, then either packer may be actuated first.

Figure 4A:
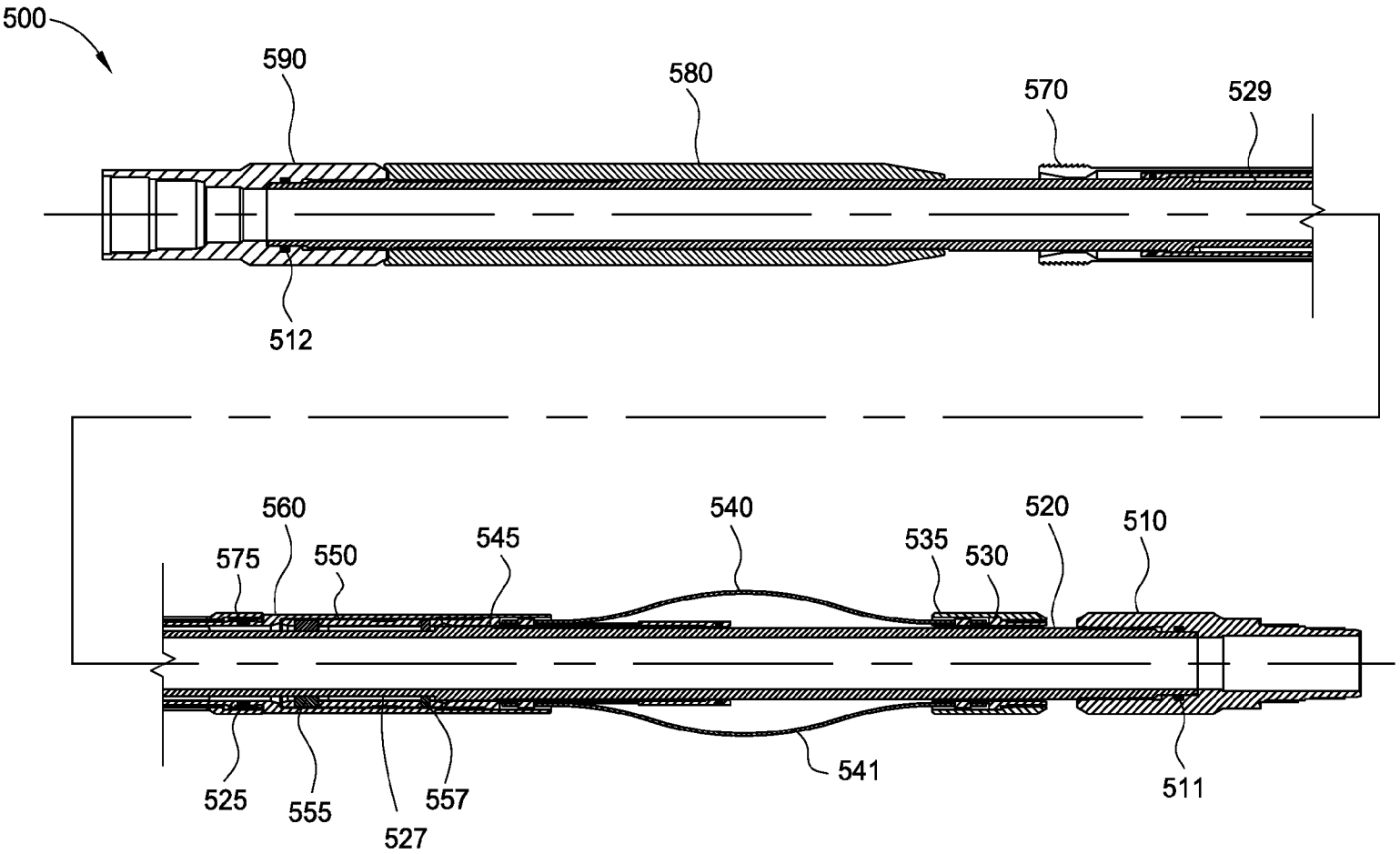
FIG. 4A illustrates a cross sectional view of an anchor in an unset position according to one embodiment of the invention.

FIG. 4A illustrates the anchor 500 in an un-actuated position according to one embodiment of the invention. The anchor 500 includes a top sub 510, an inner mandrel 520, first retainer 530, a friction section 540 (such as a drag spring or block), a second retainer 545, an inner sleeve 550, an outer sleeve 560, a slip 570, a cone 580, and a bottom sub 590. The top sub 510 includes a cylindrical body having a bore disposed through the body. The upper end of the top sub 510 may be coupled to the packer 400 or other downhole tool that may be included in the assembly 100. The lower end of the top sub 510 may be coupled to the inner mandrel 520. A seal 511, such as an o-ring, may be provided between the top sub 510/inner mandrel 520 interface.

The inner mandrel 520 includes a cylindrical body having a bore disposed through the body and slots 525 longitudinally disposed along the outer diameter of the inner mandrel 520. In one embodiment, the inner mandrel 520 may include a pair of slots 525. The slots 525 may be symmetrically located on the outer diameter of the inner mandrel 520. As will be described below, the slots 525 facilitate setting and unsetting of the anchor 500.

The friction section 540 includes a plurality of members 541 radially disposed around the inner mandrel 520 that are secured to the inner mandrel 520 at their ends with the first retainer 530 and the second retainer 545 such that the center portions of the members project outwardly from the inner mandrel 520. The friction section 540 allows axial movement of the inner mandrel 520 relative to the members 541, the outer sleeve 560, and the slip 570 by generating friction between the members 541 and the surrounding wellbore as the friction section 540 engages and moves along the surrounding wellbore. The first retainer 530 includes a cylindrical body having a bore disposed through the body, through which the inner mandrel 520 is provided. The upper end of the members 541 may include openings that engage raised portions on the outer diameter of the first retainer 530. A cover 535 may be coupled around the first retainer 530 to prevent disengagement of the raised portions on the outer diameter of the first retainer 530 and the openings in the upper end of the members 541. The cover 535 includes a cylindrical body having a bore disposed through the body, through which the first retainer 530 and the inner mandrel 520 are provided. The cover 535 may be coupled to the first retainer 530. The first retainer 530 and the cover 535 may be axially movable relative to the inner mandrel 520.

At the opposite side, the lower end of the members 541 may similarly be coupled to the second retainer 545. The second retainer 545 includes a cylindrical body having a bore disposed through the body, through which the inner mandrel 520 is provided. The second retainer 545 includes raised portions on its outer diameter for engaging openings disposed through the lower end of the members 541. The outer sleeve 560 may be coupled around the second retainer 545 to prevent disengagement of the raised portions on the outer diameter of the second retainer 545 and the openings in the lower end of the members 541. The outer sleeve 560 includes a cylindrical body having a bore disposed through the body, through which the first retainer 530, the inner sleeve 550, and the inner mandrel 520 are provided. The upper end of the outer sleeve 560 may be coupled to the second retainer 545. The second retainer 545 and the outer sleeve 560 may be axially movable relative to the inner mandrel 520.

The lower end of the outer sleeve 560 may include a shoulder disposed on its inner diameter that engages a shoulder disposed on the outer diameter of the inner mandrel 520 to limit the axial movement between the two components. Coupled to the lower end of the outer diameter of the outer sleeve 560 is the slip 570. The slip 570 may be coupled to the outer sleeve 560 via a threaded insert 575 that is partially disposed in the body of the outer sleeve 560. The slip 570 may include a plurality of slip members, such as collets, radially disposed around the slip 570 having teeth disposed on the outer periphery of the ends of the slip members to engage and secure the anchor 500 in the wellbore. The ends of the slip members include a tapered inner diameter for receiving the corresponding tapered outer surface of the cone 580. Upon engagement between the outer surface of the cone 580 and the inner surface of the slip 570, the cone 580 projects the slip members outwardly into engagement with the surrounding wellbore to set and secure the anchor 500 in the wellbore. In one embodiment, the wellbore may be lined with casing. In one embodiment, the wellbore may be an open hole and may not include any lining or casing.

The cone 580 includes a cylindrical body having a bore disposed through the body, through which the inner mandrel 520 is provided. The cone 580 has a tapered nose operable to engage the tapered inner surface of the slip 570. The cone 580 is axially fixed relative to the inner mandrel 520 and abuts the upper end of the bottom sub 590. The bottom sub 590 includes a cylindrical body having a bore disposed through the body, through which the inner mandrel 520 is partially provided. The upper end of the bottom sub 590 is coupled to the lower end of the inner mandrel 520. A seal 512, such as an o-ring, may be provided between the bottom sub 590/inner mandrel 520 interface. The lower end of the bottom sub 590 may be configured to connect to a variety of other downhole tools that may be included or attached to the assembly 100.

To set and unset the slip 570 by engagement with the cone 580, the relative movement between the inner mandrel 520 (and thus the cone 580) and the outer sleeve 560 (and thus the slip 570) is controlled with a pair of lugs 555 and a pair of pins 557 that are disposed through the inner sleeve 550 and facilitated with the friction section 540. The friction section 540 creates a friction interface with the wellbore to allow the inner mandrel 520 to move axially relative to the outer sleeve 560 as the assembly 100 is raised and lowered. The inner sleeve 550 includes a cylindrical body having a bore disposed through that body that is disposed between the upper end of the outer sleeve 560 and the inner mandrel 520, adjacent the second retainer 545. The inner sleeve 550 is rotatable relative to the outer sleeve 560 and the inner mandrel 520, as the inner mandrel 520 is moved in an "up and down" motion relative to the inner sleeve 550 and the outer sleeve 560. The lugs 555 and the pins 557 are further seated within the slots 525 located on the outer diameter of the inner mandrel 520.

Figure 4B:
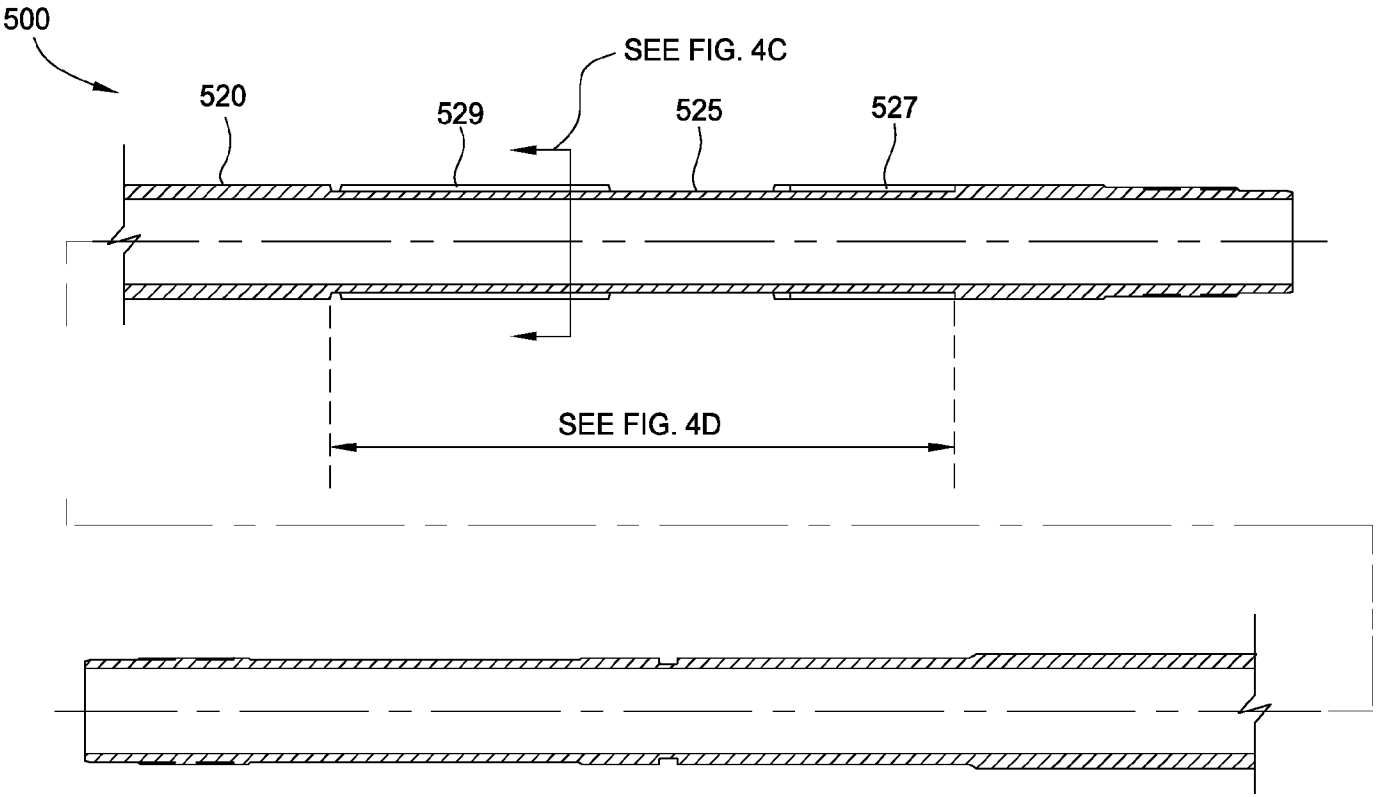
FIG. 4B illustrates a cross sectional view of an inner mandrel of the anchor according to one embodiment of the invention.
Figure 4C:
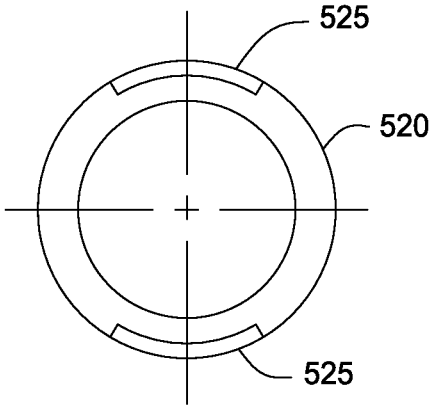
FIG. 4C illustrates a top cross sectional view of the inner mandrel of the anchor according to one embodiment of the invention.
Figure 4D:
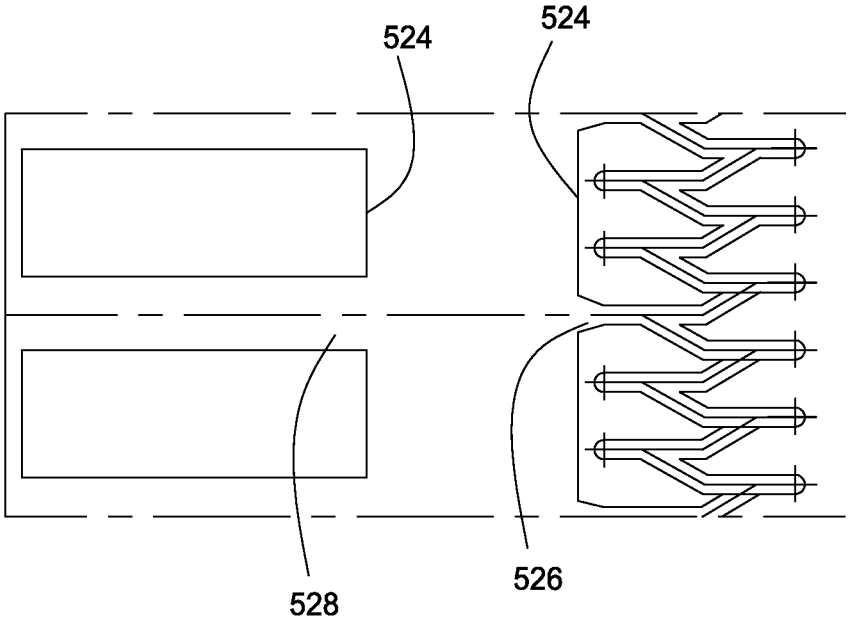
FIG. 4D illustrates a track and channel layout of the inner mandrel according to one embodiment of the invention.
Figure 4E:
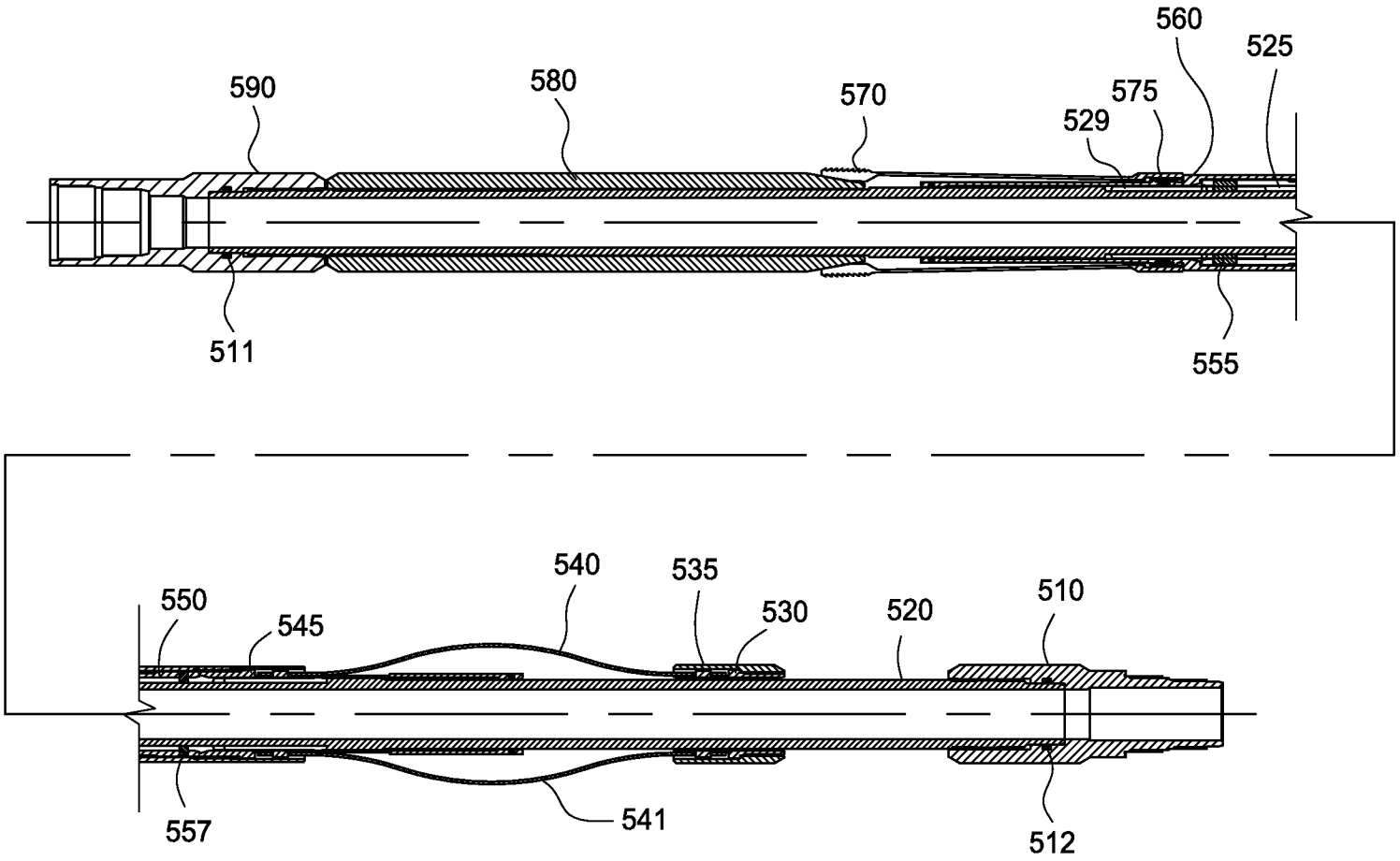
FIG. 4E illustrates a cross sectional view of the anchor in a set position according to one embodiment of the invention.

As illustrated in FIGS. 4B-4D, the slots 525 include a cam portion 527, along which the pins 557 travel, and a channel portion 529, through which the lugs 555 may travel to set and release the anchor 500. When the pins 557 are located within the cam portion 527, the anchor 500 is prevented from setting. The cam portion 527 includes a plurality of lanes having linear sections and helical sections that are directed into adjacent lanes. The cam portion 527 further includes exits 526 in lanes that communicate and align with channels 528 of the channel portion 529. As the inner mandrel 520 is pulled and pushed in an "up and down" motion, via the top sub 510 that is coupled to the tubing string 110 through the remainder of the assembly 100, the pins 557 move along the lanes of the cam portion 527 and are continuously directed into adjacent lanes such that the outer sleeve 550 rotates relative to the inner mandrel 520. The pins 557 travel along the cam portion 527 until they reach exits 526 and are allowed to exit from the cam portion 527 by an upward or pull force. As the inner mandrel 520 is directed in the "up and down" motion, the lugs 555 may be aligned with and located relative to the pins 557 to engage the outer rims 524 of the cam portion 527 and the channel portion 529 to prevent the pins 557 from contacting the ends of the lanes in the cam portion 527 and protect them from bearing any excessive loads induced by forces applied to the inner mandrel 520. When the pins 557 reach an exit 526, the lugs 555 may travel into channels 528, which keeps the pins 557 in alignment with the exits 526 and allows further axial movement of the inner mandrel 520. Upon the pins 557 exiting and the lugs 555 traveling within the channels 528 by the upward or pull force, the inner mandrel 520 is permitted to move further axially relative to the outer sleeve 560, thereby allowing the cone 580 to engage the slip 570 and actuate the slip members into engagement with the wellbore, as illustrated in FIG. 4E. After the slip 570 is engaged with the wellbore, the assembly 100 is secured in the wellbore as it is held in tension via the tubing string 110.

To unset the slip 570, the tension in the assembly 100 is released and/or a downward or push force is applied to the inner mandrel 520, using the tubing string 110, thereby reintroducing the pins 557 onto the cam portion 527 via the exits 526 and permitting the cone 580 to retract from engagement with the slip 570 and the slip members to retract from engagement with the wellbore. Once the pins 557 are directed into the cam portion 527, the pins 557, the lugs 555, and the cam portion 527 limit the axial movement between the cone 580 and the slip 570 to prevent setting of the slip 570 as described above. In alternative embodiments, the cam portion 527 may include other configurations that allow the pins 557 to move along the cam portion 527 and to exit/enter the cam portion 527 to set and unset the anchor 100. After the anchor 500 is released from engagement with the wellbore, the assembly 100 may be relocated to another area of interest or location in the wellbore to conduct another fracturing or other downhole operation following the operation of the assembly 100 described herein.

Figure 5A:
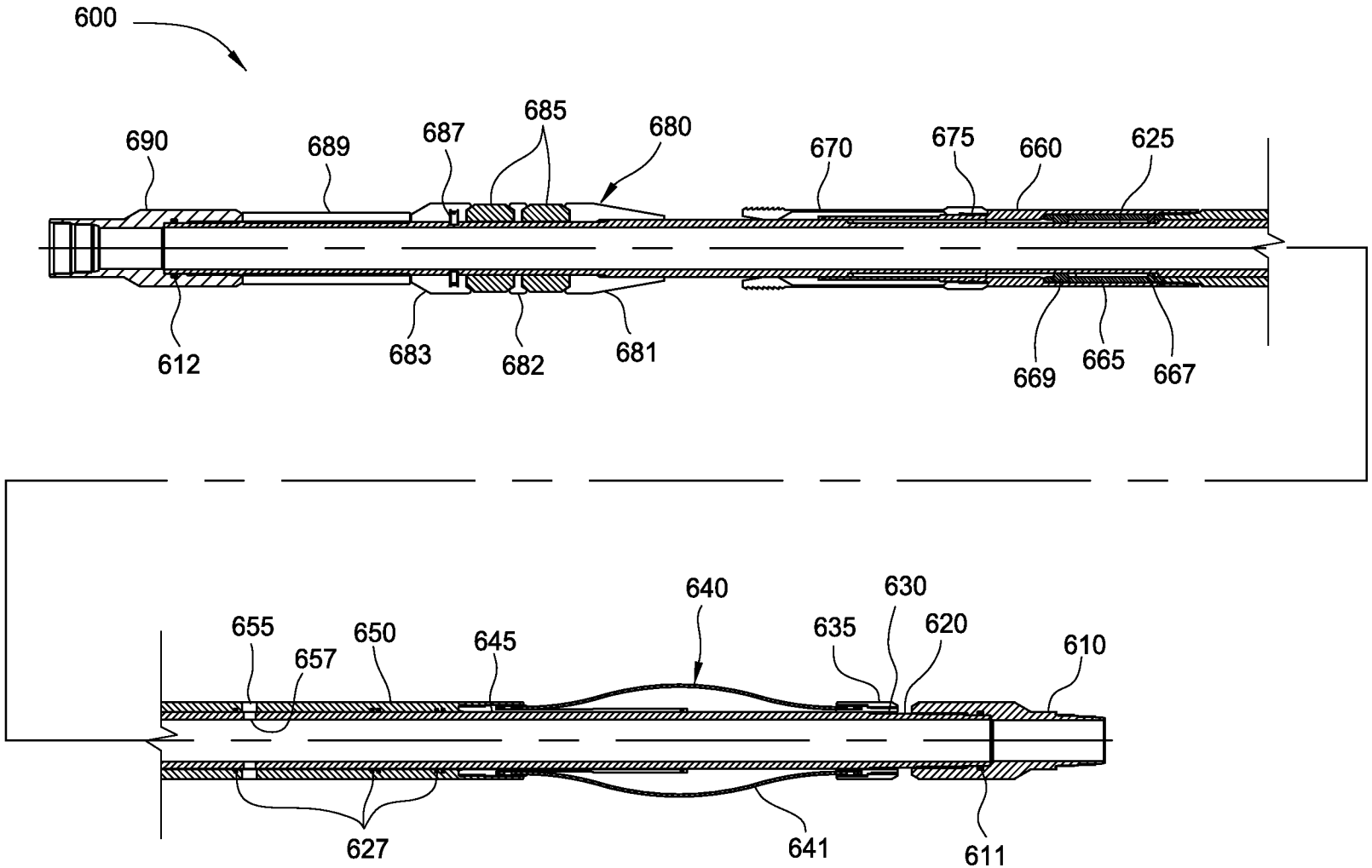
FIG. 5A illustrates a cross sectional view of an anchor in an unset position according to one embodiment of the invention.

FIG. 5A illustrates an embodiment of an anchor assembly 600 in an un-actuated position. The anchor assembly 600 may be used in combination with the embodiments of the assembly 100 described herein. The anchor 600 includes a top sub 610, an inner mandrel 620, a first retainer 630, a friction section 640 (such as a drag spring or block), a second retainer 645, an unloading sleeve 650, an outer sleeve 660, a slip 670, a cone assembly 680, and a bottom sub 690. The top sub 610 includes a cylindrical body having a bore disposed through the body. The upper end of the top sub 610 may be coupled to the packer 400 or other downhole tool that may be included in the assembly 100. The lower end of the top sub 610 may be coupled to the inner mandrel 620. A seal 611, such as an o-ring, may be provided between the top sub 610/inner mandrel 620 interface.

The inner mandrel 620 includes a cylindrical body having a bore disposed through the body, one or more ports 657, and slots 625 longitudinally disposed along the outer diameter of the inner mandrel 620. The ports 657 are operable to facilitate unloading of the pressure in the assembly 100 and to facilitate unsetting of the packer 400 located above the anchor 600 by equalizing the pressure across the packer. In one embodiment, the inner mandrel 620 may include a pair of slots 625. The slots 625 may be symmetrically located on the outer diameter of the inner mandrel 620. As described above with respect to FIGS. 5B-5D, the slots 625 similarly facilitate setting and unsetting of the assembly 600.

The friction section 640 includes a plurality of members 641 radially disposed around the inner mandrel 620 that are secured to the inner mandrel 620 at their ends with the first retainer 630 and the second retainer 645 such that the center portions of the members project outwardly from the inner mandrel 620. The friction section 640 allows axial movement of the inner mandrel 620 relative to the members 641, the sleeves 650 and 660, and the slip 670 by generating friction between the members 641 and the surrounding wellbore as the friction section 640 engages and moves along the surrounding wellbore. The first retainer 630 includes a cylindrical body having a bore disposed through the body, through which the inner mandrel 620 is provided. The upper end of the members 641 may include openings that engage raised portions on the outer diameter of the first retainer 630. A cover 635 may be coupled around the first retainer 630 to prevent disengagement of the raised portions on the outer diameter of the first retainer 630 and the openings in the upper end of the members 641. The cover 635 includes a cylindrical body having a bore disposed through the body, through which the first retainer 630 and the inner mandrel 620 are provided. The cover 635 may be coupled to the first retainer 630. The first retainer 630 and the cover 635 may be axially movable relative to the inner mandrel 620.

At the opposite side, the lower end of the members 641 may similarly be coupled to the second retainer 645. The second retainer 645 includes a cylindrical body having a bore disposed through the body, through which the inner mandrel 520 is provided. The second retainer 645 includes raised portions on its outer diameter for engaging openings disposed through the lower end of the members 641. The unloading sleeve 650 may be coupled to the second retainer 645 to prevent disengagement of the raised portions on the outer diameter of the second retainer 645 and the openings in the lower end of the members 641. The unloading sleeve 650 includes a cylindrical body having a bore disposed through the body, through which the first retainer 630 and the inner mandrel 620 are provided. The unloading sleeve 650 also includes one or more ports 655 that communicate with the one or more ports 657 in the inner mandrel 620 when the ports are aligned, generally when the anchor 600 is in the unset position. The ports 655 and 657 provide fluid communication between the assembly 100 and the wellbore surrounding the assembly 100 to relieve pressure internal of the assembly 100 and to help equalize the pressure across the packer 400 located above the anchor 600. One or more seals 627, such as o-rings, may be located between the loading sleeve 650/inner mandrel 620 interface to provide seals above and below the ports 655 and 657. The upper end of the unloading sleeve 650 may be coupled to the second retainer 645. The inner mandrel 620 is axially moveable relative to the second retainer 645 and the unloading sleeve 650.

Coupled to the lower end of the unloading sleeve 650, is the outer sleeve 660. The outer sleeve 660 may include a cylindrical body having a bore therethrough, which surrounds the inner mandrel 620 and an inner sleeve 665. The lower end of the outer sleeve 660 is coupled to the slip 670. The slip 570 may be coupled to the outer sleeve 660 via a threaded insert 675 that is partially disposed in the body of the outer sleeve 660. The slip 670 may include a plurality of slip members, such as collets, radially disposed around the slip 670 having teeth disposed on the outer periphery of the ends of the slip members to engage and secure the anchor 600 in the wellbore. The ends of the slip members include a tapered inner diameter for receiving the corresponding tapered outer surface of the cone assembly 680. Upon engagement between the outer surface of the cone assembly 680 and the inner surface of the slip 670, the cone assembly 680 projects the slip members outwardly into engagement with the surrounding wellbore to set and secure the anchor 600 in the wellbore. In one embodiment, the wellbore may be lined with casing. In one embodiment, the wellbore may be an open hole, and may not include any lining or casing.

The cone assembly 680 includes an upper portion 681, a middle portion 682, a lower portion 683, and one or more packing elements 685 located adjacent the middle portion 682. Each of the portions may include cylindrical bodies having a bore disposed through the body, through which the inner mandrel 620 is provided. The upper portion 681 has a tapered nose operable to engage the tapered inner surface of the slip 670, and an inner shoulder operable to engage a shoulder on the outer diameter of the inner mandrel 620. The packing elements 685 are located one each side of the middle portion 682. Each of the portions includes a lip profile at their outer edges that are operable to retain the packing elements 685 therebetween. The lower portion 683 may be axially and shearably fixed relative to the inner mandrel 620 via a retainer 687. The upper and middle portions 681 and 682 are movable relative to the lower portion 683, to allow actuation of the packing elements 685. Upon engagement with the slip 670, the upper and middle portions 681 and 682 are directed toward the fixed lower portion 683, thereby compressing the packing elements 685 into engagement with the surrounding wellbore. The packing elements 685 may be formed from an elastomeric material.

The lower portion 683 abuts the upper end of a mandrel 689, which abuts the bottom sub 690. The mandrel 689 may include a cylindrical body having a bore therethrough that surrounds the inner mandrel 620. The mandrel 689 may be operable to help position the cone assembly 680 along the lower end of the anchor 600 and to transfer loads from and provide a reactive force against the cone assembly 680. The bottom sub 690 includes a cylindrical body having a bore disposed through the body, through which the inner mandrel 620 is partially provided. The upper end of the bottom sub 690 is coupled to the lower end of the inner mandrel 620. A seal 612, such as an o-ring, may be provided between the bottom sub 690/inner mandrel 620 interface. The lower end of the bottom sub 690 may be configured to connect to a variety of other downhole tools that may be included or attached to the assembly 100.

To set and unset the slip 670, the relative movement between the inner mandrel 620 (and thus the cone 680) and the outer sleeve 660 (and thus the slip 670) is controlled with a pair of lugs 669 and a pair of pins 667 that are disposed through the inner sleeve 665 and facilitated with the friction section 640. The friction section 640 creates a friction interface with the wellbore to allow the inner mandrel 620 to move axially relative to the outer sleeve 660 as the assembly 100 is raised and lowered on the tubing string 110. The inner sleeve 665 includes a cylindrical body having a bore disposed through the body that is disposed between the outer sleeve 660 and the loading sleeve 650. The inner sleeve 665 is rotatable relative to the outer sleeve 660 and the inner mandrel 620, as the inner mandrel 620 is moved in an "up and down" motion relative to the inner sleeve 665 and the outer sleeve 660 by the use of lugs 669 and pins 667 that are seated within the slots 625 located on the outer diameter of the inner mandrel 620. The lugs 669 and pins 667 are actuated along the slots 625 as described above with the operation of the anchor 500, as shown in FIGS. 4B-4D. Upon actuation of the lugs 669/pins 667/slots 625/outer sleeve 665 interface, the cone assembly 680 is directed into engagement with the slip 670, via the inner mandrel 620 and the top sub 610, by an upward or pull force on the tubing string 110 of the assembly 100.

Figure 5B:
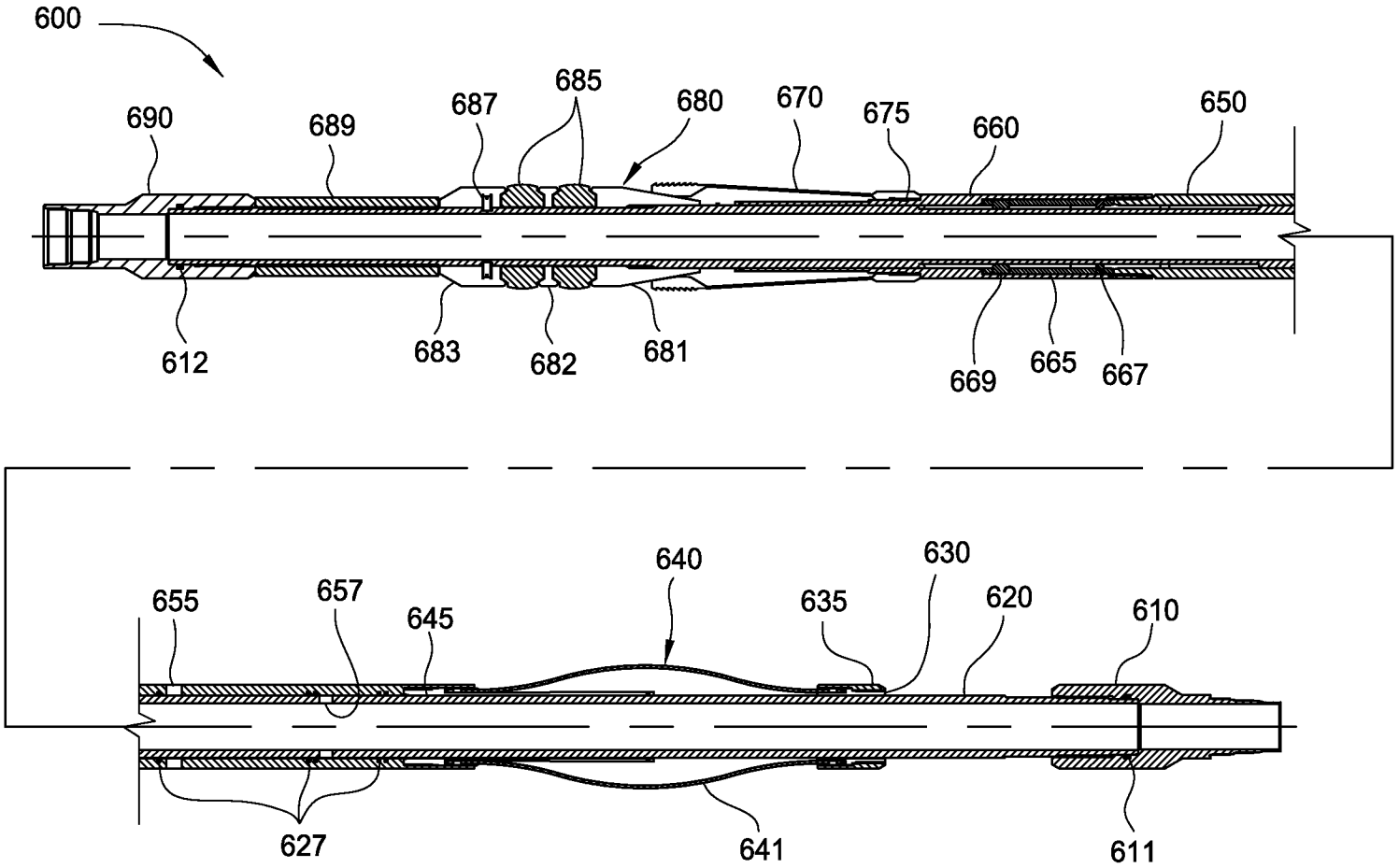
FIG. 5B illustrates a cross sectional view of the anchor in a set position according to one embodiment of the invention.
Figure 5C:
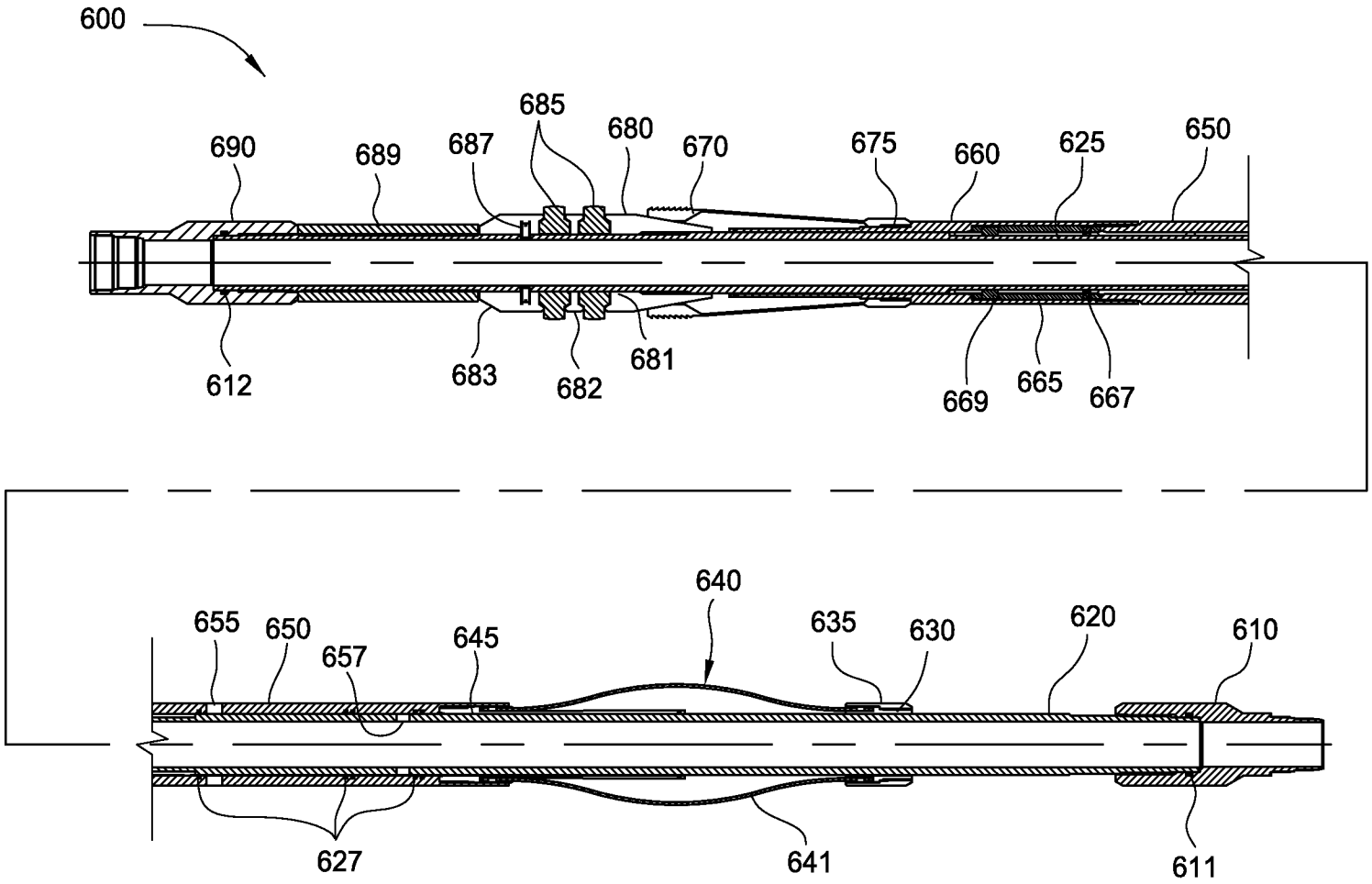
FIG. 5C illustrates a cross sectional view of the anchor in a pack-off position according to one embodiment of the invention.

FIG. 5B illustrates the initial engagement of the slip 670 and the cone assembly 680. The slip 670 is projected into engagement with the surrounding wellbore and the packing elements 685 are compressed within the cone assembly 680. Further tensioning of the anchor 600 forces the cone assembly 680 to project the slips into a set position within the wellbore and allows the packing elements to sealingly engage the wellbore, as shown in FIG. 5C. Also shown in FIGS. 5B and 5C are the ports 655 and 657 sealingly isolated from each other. When the anchor 600 is in the set position, fluid communication is closed between the throughbore of the anchor 600 and the surrounding wellbore. This allows a fracturing operation to be conducted without a loss of pressure through the anchor 600 using the embodiments described above.

To unset the slip 670 and the packing elements 685, the tension in the assembly 100 is released and/or a downward or push force is applied to the inner mandrel 520, using the tubing string 110, thereby permitting the cone assembly 680 to retract from engagement with the slip 670. The slip members and the packing elements retract from engagement with the wellbore, and the packing elements 685 retract the middle and upper portions of the cone assembly 680 from the lower portion. When the anchor 600 is in an unset position, the ports 655 and 657 may open fluid communication between the throughbore of the anchor 600 and the surrounding wellbore to equalize the pressure differential therebetween, as well as across the packer 400 located above the anchor 600. After the anchor 600 is released from engagement with the wellbore, the assembly 100 may be relocated to another area of interest or location in the wellbore to conduct another fracturing or other downhole operation following the operation of the assembly 100 described herein.

Figure 6A:
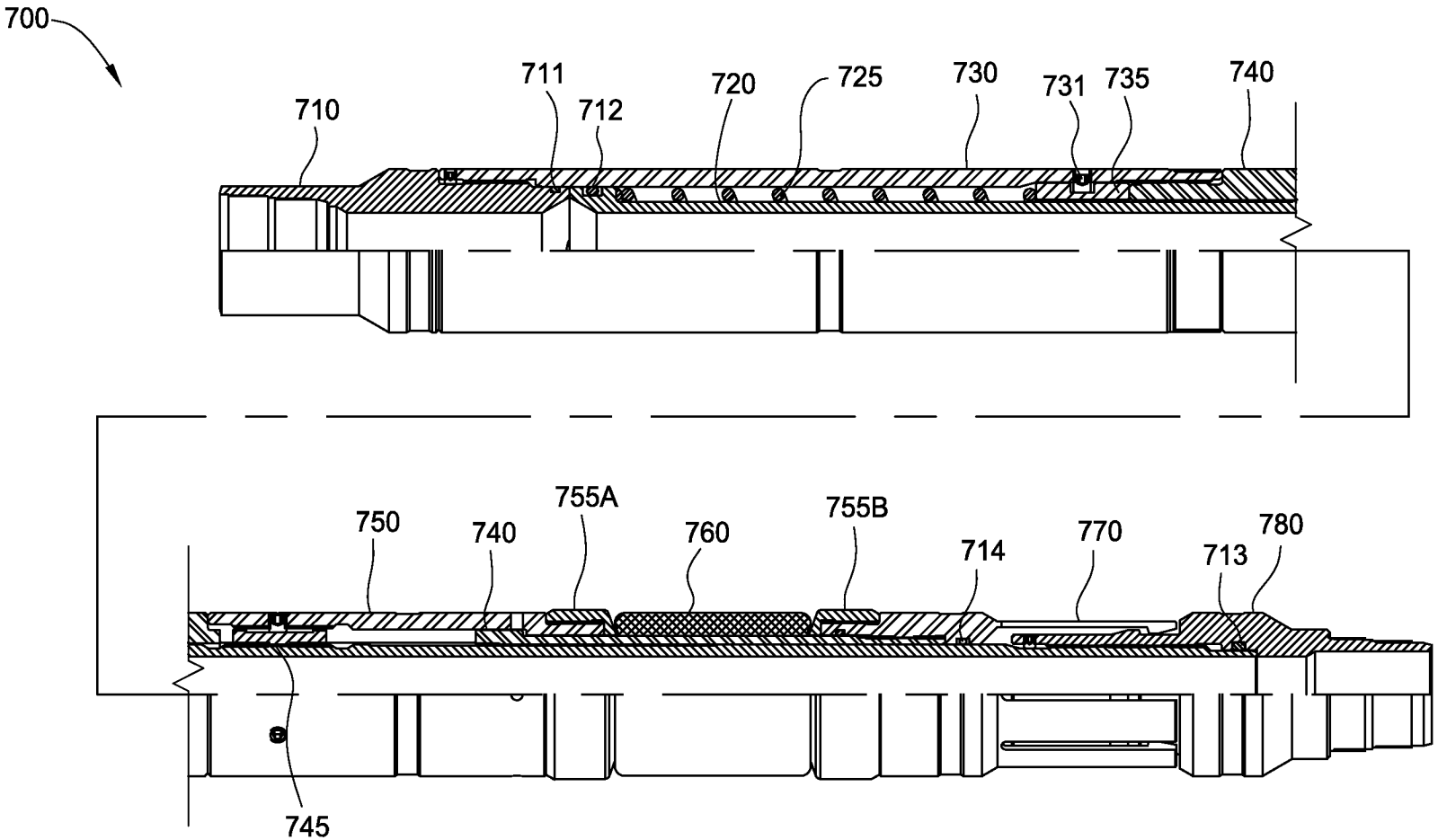
FIG. 6A illustrates a cross sectional view of a packer in an unset position according to one embodiment of the invention.

FIG. 6A illustrates a packer 700 in an unset position according to one embodiment of the invention. The packer 700 may be configured as part of the assembly 100 to be selectively actuated by an upward or pull force that induces tension in the assembly 100, via the tubing string 110 for example. One or more of the packers 700 may be used in combination with packer 400, for example, to straddle or sealingly isolate an area of interest in a formation for conducting a fracturing operation to recover hydrocarbons from the formation.

The packer 700 includes a top sub 710, an inner mandrel 720, an upper housing 730, a spring mandrel 740, a lower housing 750, a packing element 760, a latch sub 770, and a bottom sub 780. The top sub 710 includes a cylindrical body having a bore disposed through the body. The inner diameter of the upper end of the top sub 710 may be configured to connect to the unloader 200 or other downhole tool of the assembly 100. The lower end of the top sub 710 is coupled to the upper end of the upper housing 730. The top sub 710/upper housing 730 interface may be secured together using, for example, a set screw. The top sub 710/upper housing 730 interface may also include a seal 711, such as an o-ring.

The upper housing 730 includes a cylindrical body having a bore disposed through the body, through which the inner mandrel 720 is provided. The upper housing 730 surrounds the upper end of the inner mandrel 720 such that the bottom end of the top sub 710 abuts the top end of the inner mandrel 720. A seal 712, such as an o-ring, may be provided between the upper housing 730/inner mandrel 720 interface. The upper housing 730 encloses a biasing member 725 that surrounds the inner mandrel 720. The biasing member 725 may include a spring that abuts a shoulder formed on the outer diameter of the upper end of the inner mandrel 720 at one end and abuts the upper end of a retainer 735 at the other end, thereby biasing the inner mandrel 720 against the bottom end of the top sub 710. The biasing member 725 may be used to facilitate unsetting of the packing element 760. The retainer 735 includes a cylindrical body having a bore disposed through the body, through which the inner mandrel 720 is provided. The retainer 735 is surrounded by and coupled to the upper housing 730 by a set screw 731. In an alternative embodiment, the retainer 735 may be integral with the upper housing 730 in the form of a shoulder, for example, on the upper housing 700 against which the biasing member 725 abuts. The lower end of the upper housing 730 is coupled to the spring mandrel 740. The inner diameter of the lower end of the upper housing 730 may be coupled to the outer diameter of the upper end of the spring mandrel 740 such that the upper end of the spring mandrel abuts the retainer 735.

The spring mandrel 740 includes a cylindrical body having a bore disposed through the body, in which the inner mandrel 720 is provided. The lower end of the spring mandrel 740 is coupled to the latch sub 770 to facilitate actuation of the packing element 760. An inner shoulder of the latch sub 770 abuts an edge of the spring mandrel 740. The spring mandrel 740 includes longitudinal slots disposed on its outer diameter for receiving a member 745 that also facilitates actuation of the packing element 760. The member 745 is disposed on and coupled to the inner mandrel 720, and is surrounded by and further coupled to the lower housing 750. The member 745 may include a recess on its outer diameter for receiving a set screw disposed through the body of the lower housing 750 to axially fix the lower housing 750 relative to the inner mandrel 720. The lower housing 750 includes a cylindrical body having a bore disposed through the body, through which the inner mandrel 720 is provided. Also, the lower end of the lower housing 750 surrounds a portion of the spring mandrel 740 such that a shoulder formed on the inner diameter of the lower housing 750 abuts a shoulder formed on the outer diameter of the spring mandrel 740.

As stated above, the lower end of the spring mandrel 740 may be connected to the latch sub 770, which includes a plurality of latching fingers, such as collets, that engage the outer diameter of the bottom sub 780. The packing element 760 may include an elastomer that is disposed around the spring mandrel 740 and between an upper and lower gage 755A and 755B. The gages 755A and 755B are connected to the outer diameters of the lower housing 750 and the latch sub 770, respectively, and include radially inward projecting ends that engage the ends of the packing element 760 to actuate the packing element 760. The latch sub 770/inner mandrel 720 interface may also include a seal 714, such as an o-ring.

The bottom sub 780 includes a cylindrical body having a bore disposed through the body and is coupled to the lower end of the inner mandrel 720. The bottom sub 780/inner mandrel 720 interface may be secured together using, for example, a set screw. The bottom sub 780/inner mandrel 720 interface may also include a seal 713, such as an o-ring. A recessed portion on the outer diameter of the bottom sub 780 is adapted for receiving the latching fingers of the latch sub 770 to prevent premature actuation of the packing element 760. The lower end of the bottom sub 780 may be configured to be coupled to the spacer pipe 130, the anchor 500, or other downhole tool that may be included in the assembly 100.

Figure 6B:
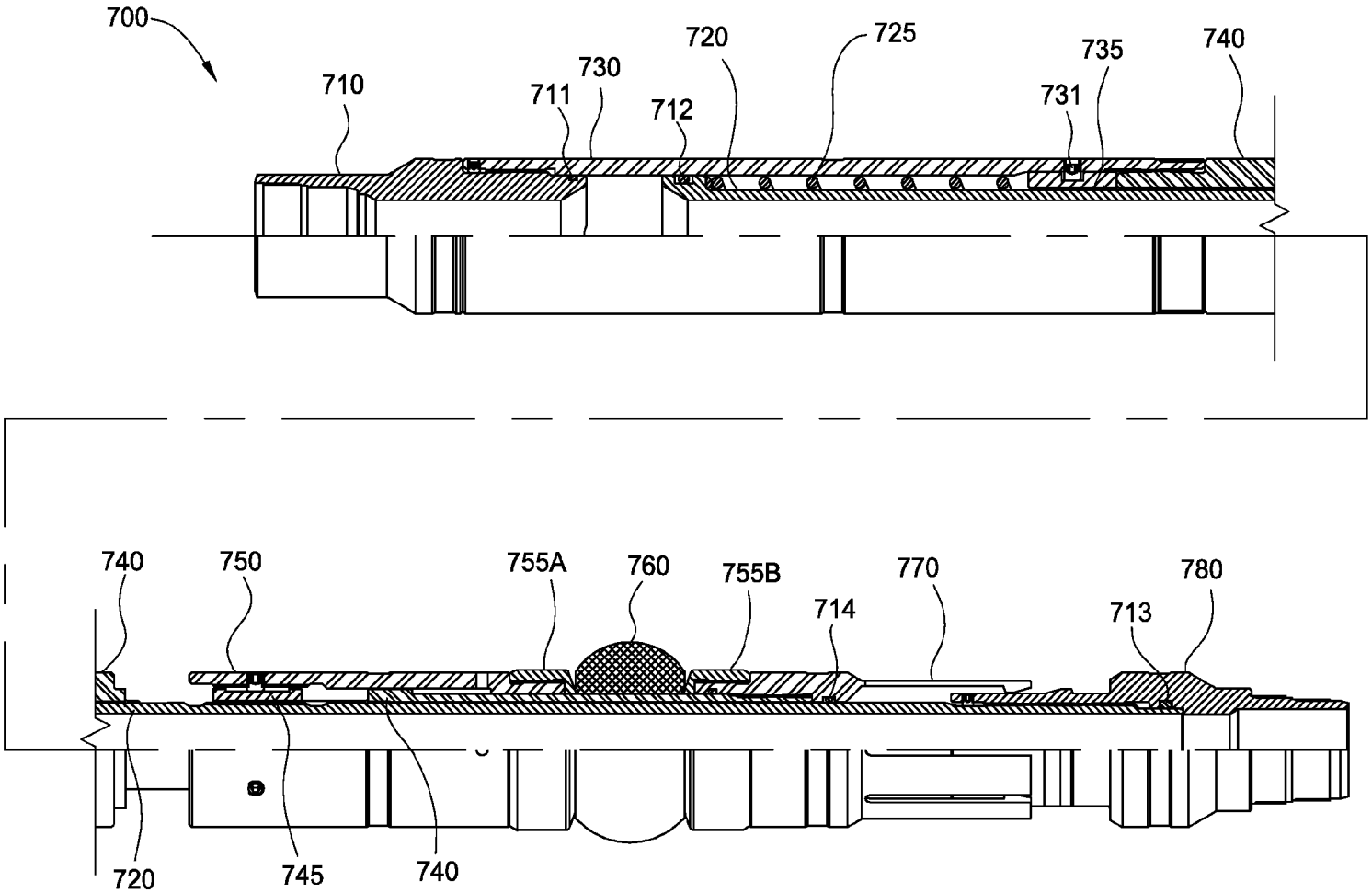
FIG. 6B illustrates a cross sectional view of the packer of FIG. 6A in a set position.

FIG. 6B illustrates the packer 700 in a set position according to one embodiment of the invention. The top sub 710, the upper housing 730, the retainer 735, the spring mandrel 740, and the latch sub 770 are axially movable relative to the inner mandrel 720, the lower housing 750, and the bottom sub 780. As the assembly 100 is tensioned, the top sub 710 is separated from the inner mandrel 720, thereby compressing the biasing member 725 between the shoulder on the inner mandrel 720 and the retainer 735, and the spring mandrel 740 is separated from the lower housing 750, thereby axially moving along the outer diameter of the inner mandrel 720 and pulling on the latch sub 770. Upon the upward or pull force applied to the top sub 710, via the tubing string 110 for example, the latching fingers of the latch sub 770 disengage from the bottom sub 780 to actuate the packing element 760. The latch sub 770 and thus the lower gage 755B are axially moved toward the stationary lower housing 750 and upper gage 755A to actuate the packing element 760 disposed therebetween. The lower housing 750 is axially fixed by the anchor 500 (as will be described below) via the member 745, inner mandrel 720, and bottom sub 780. The packing element 760 is actuated into sealing engagement with the surrounding surface, which may be the wellbore for example. Once the packer 700 is set, fluid pressure that is introduced into the assembly 100 for the fracturing operation may boost the sealing effect of the packing element 760 by telescoping apart the top sub 710 and the inner mandrel 720 as the pressure acts on the bottom end of the top sub 710 and the top end of the inner mandrel 720. The bottom sub 780 may include a piston shoulder on its inner diameter to counter balance the boost enacted upon the packing element 360 to control setting and unsetting of the packing element 760. By releasing the tension in the assembly 100 and/or pushing on the tubing string 110, the top sub 710 and thus the latch sub 770 may be retracted, with further assistance from the biasing member 725, relative to the inner mandrel 720 to unset the packing element 360.

Figure 7A:
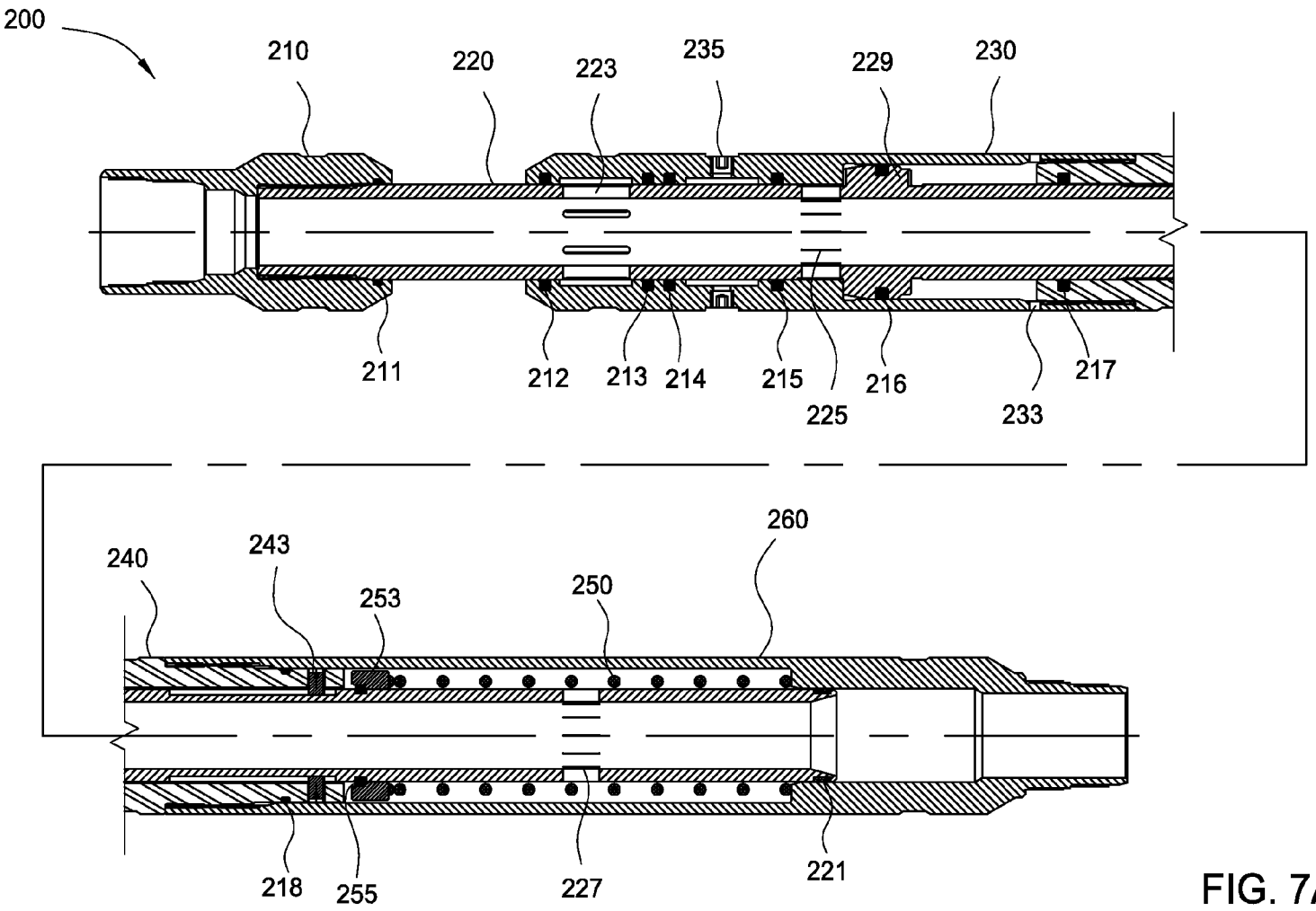
FIG. 7A illustrates a cross sectional view of an unloader in a closed position according to one embodiment of the invention.

FIG. 7A illustrates the unloader 200 according to one embodiment of the invention. The unloader 200 is operable to help equalize the pressure above and below the packer 400A, 700 to reduce the pressure differential subjected to the packer 400A, 700 during unsetting of the packer, as well as equalize the pressure internal and external to the assembly 100. This pressure equalization helps unset the packer 400A, 700 from the wellbore, so that the assembly 100 may be moved in the wellbore without damaging the packer 400A, 700 for subsequent sealing. The unloader 200 is operable to open and close fluid communication between the tubing string 110 and the annulus of the wellbore surrounding the assembly 100. When the assembly 100 is being located and secured in the wellbore, and when the assembly 100 is being tensioned by pulling on the tubing string 110, the unloader 200 may be actuated and maintained in a closed position. The unloader 200 may then be actuated into an open position after the assembly 100 is released from being tensioned by the tubing string 110 and/or a downward or push force is applied to the assembly 100 via the tubing string 110.

The unloader 200 includes a top sub 210, an inner mandrel 220, an upper housing 230, a coupler 240, a biasing member 250, and a lower housing 260. The top sub 210 comprises a cylindrical body having a bore disposed through the body. In one embodiment, the upper end of the top sub 210 may be coupled to the adapter sub 120. In one embodiment, the upper end of the top sub 210 is configured to couple the unloader 200 to a tubing string or other downhole tool positioned above the unloader 200. The lower end of the top sub 210 is coupled to the upper end of the inner mandrel 220. The inner diameter of the top sub 210 is connected to the outer diameter of the inner mandrel 220, such as by a thread, and a seal 211, such as an o-ring, may be used to seal the top sub 210/inner mandrel 220 interface. The top sub 210 is connected to the inner mandrel 220 such that the components are in fluid communication.

The inner mandrel 220 comprises a cylindrical body having a bore disposed through the body. The inner mandrel 220 further includes a first opening 223, a second opening 225, a third opening 227, and a piston 225. The openings 223, 225, 227 may vary in number, may be symmetrically located about the body, and may include laser cut slots disposed through the walls of the body to filter sand, particulates, or other debris from exiting or entering the bore of the inner mandrel 220. The first and second openings 223, 225 and the piston 225 are surrounded by the upper housing 230. The third opening 227 is surrounded by the lower housing 260. The coupler 240 also surrounds the body of the inner mandrel 220 and is disposed between the upper and lower housings 230 and 260 such that the upper housing is coupled to the upper end of the coupler 240 and the lower housing is coupled to the lower end of the coupler 240, thereby enclosing the lower end of the inner mandrel 220. The inner diameters of the housings 230 and 260 may be threadedly coupled to the outer diameter of the coupler 240. The inner mandrel 220 is axially movable relative to the housings 230 and 260 and the coupler 240.

The upper housing 230 includes a cylindrical body having a bore disposed through the body, through which the inner mandrel 220 is provided. The upper housing 230 includes an opening 235 disposed through the body of the housing that establishes fluid communication between the bore of the inner mandrel 220 and the annulus surrounding the unloader 200 via the first opening 223 of the inner mandrel 220. The opening 235 may comprise a nozzle to controllably inject fluid into the annulus surrounding the unloader 200. When the unloader 200 is in the closed position, the first opening 223 of the inner mandrel 220 is sealingly isolated from the opening 235 of the upper housing 230, and when the unloader 200 is in the open position, the first opening 223 of the inner mandrel 220 is in fluid communication with the opening 235 of the upper housing 230. The unloader is actuated into the closed and open positions by relative axial movement between the inner mandrel 220 and the upper housing 230. A plurality of seals 212, 213, 214, and 215, such as o-rings, may be used to seal the inner mandrel 220/upper housing 230 interfaces, above and below the opening 235 of the upper housing 230.

The lower end of the upper housing 230 includes an enlarged inner diameter such that the piston 229 of the inner mandrel 220 is sealingly engaged with the inner diameter of the housing 230 and engages a shoulder formed on the inner diameter of the housing 230. A seal 216, such as an o-ring, may be used to seal the piston 229/upper housing 230 interface. The piston 229 includes an enlarged shoulder disposed on the outer diameter of the inner mandrel 220. In the closed position, piston 229 of the inner mandrel 220 abuts the shoulder formed on the inner diameter of the upper housing 230. The second opening 225 of the inner mandrel 220 is located adjacent the piston 229 of the inner mandrel 220 to allow fluid pressure to be communicated from the bore of the inner mandrel 220 to the piston 229. The lower end of the upper housing 230 includes a port 233 that establishes fluid communication between the annulus surrounding the unloader 200 and a chamber formed between the upper housing 230 and the inner mandrel 220 that is disposed adjacent the piston 229 of the inner mandrel 220. The port 233 may be used to introduce pressure back into the unloader 200 to reduce the pressure differential across the piston 229. Finally, the lower end of the upper housing 230 is coupled to the upper end of the coupler 240.

The coupler 240 includes a cylindrical body having a bore disposed through the body, through which the inner mandrel 220 is provided. The coupler 240 includes a shoulder disposed on its outer diameter against which the ends of the housings 230 and 260 engage. Seals 217 and 218, such as o-rings, may be positioned between the upper housing 230/lower housing 260/coupler 240/inner mandrel 220 interfaces. A set screw 243 is disposed through the body of the coupler 240 and engages a recess in the outer diameter of the inner mandrel 220 such that the inner mandrel is axially movable relative to the coupler 240 but is rotationally fixed relative to the coupler 240 and the upper and lower housings 230 and 260. The piston 229 of the inner mandrel 220 may engage the upper end of the coupler 240 when the unloader 200 is in a fully open position. Finally, the upper end of the lower housing 260 is coupled to the lower end of the coupler 240.

The lower housing 260 includes a cylindrical body having a bore disposed through the body, through which the inner mandrel 220 is provided. The lower housing 260 also includes an enlarged inner diameter at its upper end, forming a chamber between the lower housing 260 and the inner mandrel 220 in which the biasing member 250 is disposed. The third opening 227 of the inner mandrel 220 is in fluid communication with the chamber. The lower end of the inner mandrel 220 sealingly engages a reduced inner diameter at the lower end of the lower housing 260 such that the bore of the inner mandrel 220 exits into the bore of the lower housing 260. A wiper ring 221 may be used at the lower end of the inner mandrel 220 between the inner mandrel 220/lower housing 260 interface to prevent and remove debris that flows through the unloader 200. The lower end of the lower housing 260 may be configured to threadedly connect to the packer 400A, 700 or other downhole tool of the assembly 100.

The biasing member 250 may include a spring that abuts a shoulder formed on the inner diameter of the lower housing 260 at one end and abuts a retainer 253 at the other end. The retainer 253 includes a cylindrical body that surrounds the inner mandrel 220 and is operable to retain the biasing member 250. A ring 255 that is partially disposed in the body of the inner mandrel 220 is operable to retain the retainer 253 and transmit the biasing force of the biasing member 250 against the retainer 253 to the inner mandrel 220. The ring 255 includes a cylindrical body that surrounds the inner mandrel 220, such as a split ring, that can be enclosed around the inner mandrel 220. In an alternative embodiment, the ring 255 and the retainer 253 may be integral with the inner mandrel 220 in the form of a shoulder, for example, on the inner mandrel 220 against which the biasing member 250 abuts. The biasing member 250 biases the retainer 253 against the lower end of the coupler 240, which biases the inner mandrel 220 in the closed position via the ring 255. In addition, tensioning of the tubing string 110 may also pull on the top sub 210 and thus the inner mandrel 220 to set and maintain the unloader 200 in the closed position.

Figure 7B:
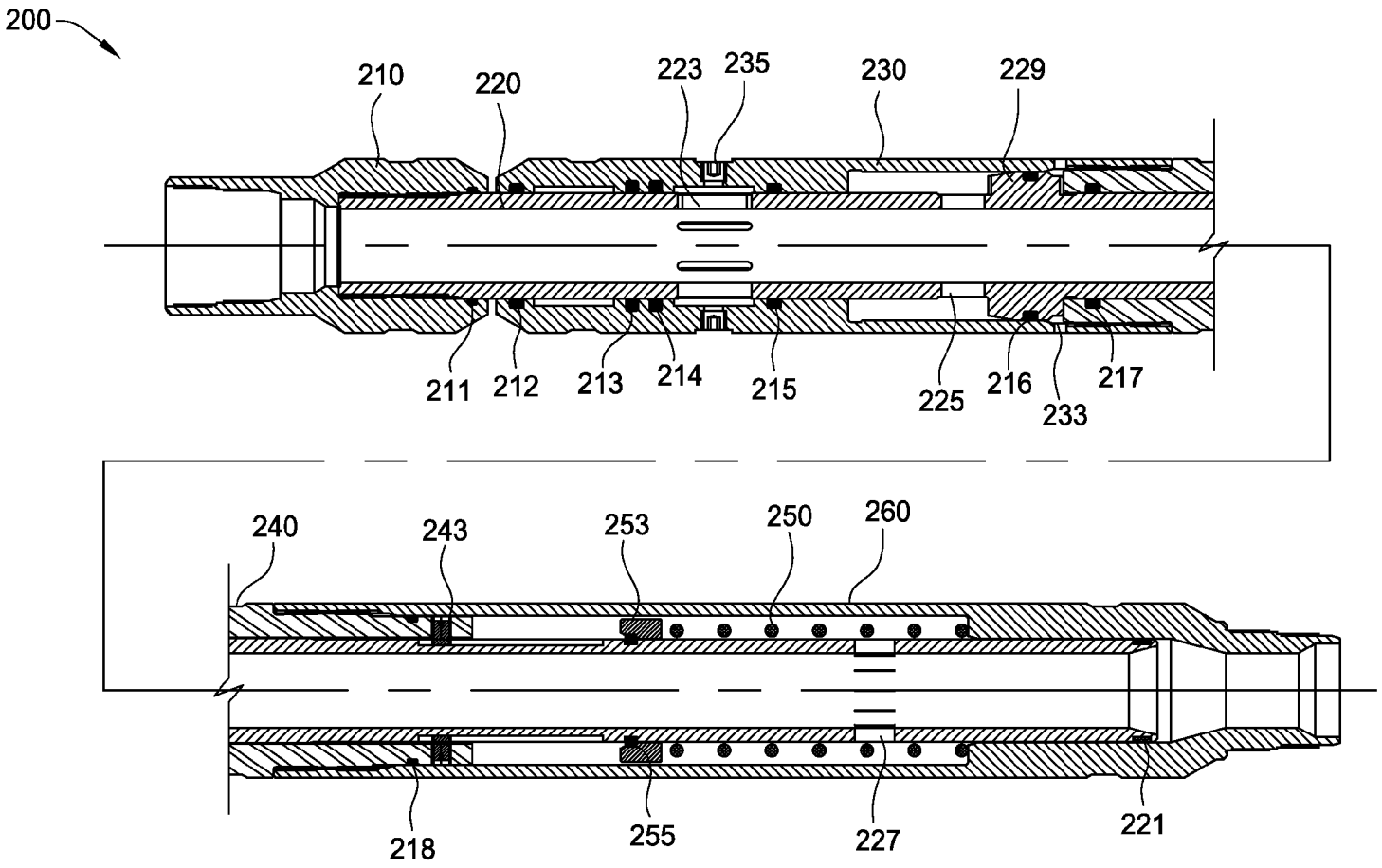
FIG. 7B illustrates a cross sectional view of the unloader in an open position according to one embodiment of the invention.

FIG. 7B illustrates the unloader 200 in the open position according to one embodiment of the invention. A downward or push force may be applied to the top sub 210 via the tubing string 110, thereby axially moving the inner mandrel 220 relative to the upper and lower housings 230 and 260 and the coupler 240 to position the first opening 223 of the inner mandrel 220 in fluid communication with the opening 235 of the upper housing. A fluid may then be injected into the annulus surrounding the unloader 200 to increase the pressure in the annulus, which may help equalize the pressure above and below the packer 400A, 700 and reduce the pressure differential across packer 400A, 700 to assist unsetting of the packer 400A, 700. At the same time, fluid pressure may be introduced onto the piston 229 of the inner mandrel 220 via the second opening 225 to help control actuation of the unloader 200 into the open position. As stated above, the port 233 may be used to introduce pressure back into the unloader 200 to reduce the pressure differential across the piston 229. Simultaneously, the ring 255, which is engaged with the inner mandrel 220, forces the retainer 253 against the biasing member 250. Fluid pressure is also introduced into the chamber between the lower housing 260 and the inner mandrel 220 via the third opening 227 of the inner mandrel 220, which may further facilitate actuation of the unloader 200 into the open position. The bottom end of the inner mandrel 220 may act as a piston surface to counter balance the piston 229 of the inner mandrel 220 which further enables controlled actuation of the unloader 200.

In one embodiment, a second unloader 200 may be disposed above the lower packer 400B, 700 and below the injection port 300 to facilitate unsetting of the packer 400B, 700. A plug, such as a solid blank pipe having no throughbore or a closed end of the injection port 300 or the second unloader 200, is located between the throughbores of the injection port 300 and the second unloader 200 so that flow through the assembly 100 is injected out through the injection port 300. Upon setting of the assembly 100, the second unloader is actuated into the closed position as described above, and a fracturing operation may be conducted in the area of interest (through the injection port 300) without any loss of pressure or fluid through the second unloader 200. After the fracturing operation is complete, the assembly 100 may be unset and the second unloader 200 may be positioned into the open position as described above, thereby opening fluid communication between the throughbore of the second unloader 200 and the wellbore surrounding the second unloader 200. The pressure in the wellbore may be directed from the area of interest in the formation, into the lower end of the assembly 100 via the second unloader 200, and then back out into the wellbore to facilitate unsetting of the packer 400B, 700. In one embodiment, an open port may be located below the packer 400B, 700 to allow the pressure from the annulus above the packer 400B, 700 to be directed to the annulus below the packer 400B, 700 via the second unloader 200 to equalize the pressure across the packer 400B, 700. In one embodiment, an anchor (further described herein) having a throughbore in communication with the wellbore may be located below the packer 400B, 700 to allow the pressure from the annulus above the packer 400B, 700 to be directed to the annulus below the packer 400B, 700 via the second unloader 200 to equalize the pressure across the packer 400B, 700.

In one embodiment, an assembly 100 may include a packer 400, an injection port 300 coupled to and disposed below the packer 400, an anchor 600 coupled to and disposed below the injection port 300, and a plug, such as a solid blank pipe having no throughbore or a closed end of the injection port 300 or the anchor 600, disposed between the throughbores of the injection port 300 and the anchor 600 so that flow through the assembly 100 is injected out through the injection port 300. The assembly 100 may be coupled to a tubing string to operate the assembly 100 as described above. When the assembly 100 actuated by applying a mechanical force (such as an upward or pull force) to the tubing string, the packer 400 and the anchor 600 are actuated to secure the assembly 100 in the wellbore and seal an area of interested located between the packing element 460 of the packer 400 and the packing element 685 of the anchor 600. A treatment fluid may be supplied through the tubing string and the first packer 400, and injected into the area of interest by the injection port 300. Fluid communication between the packer 400 and the anchor 600 and the wellbore is closed when the packer 400 and the anchor 600 are in a set position. After a treatment operation is conducted, the mechanical force may be released and/or a downward or pull force may be applied to the tubing string to release the packing element 460 of the packer 400 and the slips 670 and the packing element 685 of the anchor 600 from engagement with the wellbore. Fluid communication is opened between the anchor 600 and the wellbore as the anchor 600 is unset and the ports 657 and 655 are aligned. Pressure equalization of the packer 400 is optional due to the pressure balanced inner mandrel. In an alternative embodiment, instead of a plug, the treatment fluid may be prevented from flowing through the assembly 100 using other embodiments described above, such as a ball and seat or an overpressure valve located at the lower end of the anchor 600 to open and close fluid communication therethrough.

A method of conducting a wellbore treatment operation is provided. Initially, a pack off assembly is lowered on a tubular string such as coiled tubing into a wellbore to a zone of interest. The assembly may include an optional unloader 200, a first packer 400A, an injection port 300, a second packer 400B, and an anchor 500 or 600. The first packer 400A is positioned in the up orientation and the second packer 400B positioned in the down orientation. A seal, such as a plug, may be disposed at a bottom end of the assembly to prevent fluid communication therethrough. A mechanical force is applied to the assembly to place the assembly in tension. Sufficient mechanical force is applied to actuate the anchor 500, thereby securing the assembly in the wellbore. The mechanical force also actuates the packers 400A and 400B, thereby urging the packing elements into sealing engagement with the surrounding wellbore and isolating the zone of interest therebetween. The packers 400A, 400B may be simultaneously actuated or in sequence. If the unloader 200 is used, the mechanical force actuates the unloader into a set position such that the unloader closes fluid communication between the interior of the assembly and the annulus surrounding the unloader above the first packer.

After the assembly is secured and the packing elements are set, the wellbore treatment operation may proceed by flowing a fluid through the tubular string and the assembly and injecting the fluid into the zone of interest via the injection port 300 located between the first and second packers 400A, 400B. After completion of the wellbore treatment operation, a mechanical force may be applied to relieve the tension in the assembly, thereby releasing the assembly. The mechanical force may be applied by pushing on the coiled tubing. If an unloader 200 is used, the mechanical force opens fluid communication between the interior of the assembly and the annulus surrounding the unloader above the first packer. In this respect, pressure is allowed to equalize between the interior and the exterior of the first packer. The mechanical force also unsets the first packer 400A and the second packer 400B, thereby releasing the sealed engagement of the packers with the wellbore. The mechanical force also releases the anchor 500 from engagement with the wellbore, thereby freeing the assembly from the wellbore. As described herein with respect to unsetting the assembly, the application of one or more mechanical forces to achieve the unsetting sequence may be accomplished merely by releasing the tension which had been applied to set the assembly in place initially, or may be supplemented by additional force applied by springs within the components and/or by setting weight down on the assembly. The assembly may then be removed from the wellbore or located to another area of interest to conduct another wellbore treatment operation as described above.

In one embodiment, a packer includes an outer housing; an inner mandrel movable relative to the outer housing; and a packing element actuatable by the relative movement between the outer housing and the inner mandrel, wherein the inner mandrel is balanced against movement in response to hydraulic pressure.

In one or more of the embodiments described herein, the packer may include a biasing member configured to bias the inner mandrel relative to the outer housing along a longitudinal axis.

In one or more of the embodiments described herein, the packer is actuated by using a mechanical force applied to overcome resistance from the biasing member.

In one or more of the embodiments described herein, the packer is actuated by overcoming resistance from the biasing member.

In one or more of the embodiments described herein, the packer may include a biasing member biasing the inner mandrel against the outer housing.

In another embodiment, a method of conducting a wellbore operation includes lowering an assembly on a tubular string into a wellbore, wherein the assembly includes a first packer, an injection port, a second packer, and an anchor; locating the injection port adjacent an area of interest in the wellbore; applying a mechanical force to the assembly, thereby actuating at least one of the first packer, the second packer, and the anchor; flowing a fluid into the area of interest via the injection port; exposing both sides of a piston in at least one of the first and second packers to a fluid pressure and balancing the piston against movement in response to the fluid pressure; and releasing the mechanical force being applied to the assembly, thereby releasing the assembly from secured engagement with the wellbore.

In one or more of the embodiments described herein, the second packer is actuated before the first packer.

In another embodiment, an assembly for conducting a treatment operation in a wellbore includes a tubing string; a first packer; a second packer actuatable using a mechanical force to seal an area of interest in the wellbore and is balanced against movement in response to hydraulic pressure; an injection port disposed between the first and second packers for injecting a treatment fluid into the area of interest; and an anchor for securing the assembly in the wellbore.

In one or more of the embodiments described herein, the first packer is a mechanically set packer.

In one or more of the embodiments described herein, the first packer is a hydraulic set packer.

In one or more of the embodiments described herein, the first packer comprises an anchor equipped with a packing element.

In one or more of the embodiments described herein, the second packer includes a debris barrier formed by an interface between two components.

In another embodiment, an assembly for conducting a treatment operation in a wellbore includes a tubing string; a first packer; a second packer actuatable using a mechanical force to seal an area of interest in the wellbore and is balanced against movement in response to hydraulic pressure; an injection port disposed between the first and second packers for injecting a treatment fluid into the area of interest; and an anchor for securing the assembly in the wellbore.

In another embodiment, a method of conducting a wellbore operation includes lowering an assembly on a tubular string into a wellbore, wherein the assembly includes an upper packer, a lower packer, an injection port disposed between the upper packer and the lower packer, and an anchor; locating the injection port adjacent an area of interest in the wellbore; applying a mechanical force to the assembly, thereby actuating at least one of the upper packer, the lower packer, and the anchor; flowing a fluid into the area of interest via the injection port; exposing both sides of a piston in at least one of the upper and lower packers to a fluid pressure and balancing the piston against movement in response to the fluid pressure; and releasing the mechanical force being applied to the assembly, thereby releasing the assembly from secured engagement with the wellbore.

In one or more of the embodiments described herein, the lower packer is actuated before the upper packer.

In one or more of the embodiments described herein, the upper packer is actuated using a higher, mechanical force than the lower packer.

While the foregoing is directed to embodiments of the invention, other and further embodiments of the invention may be devised without departing from the basic scope thereof, and the scope thereof is determined by the claims that follow.

We claim:

1. A packer, comprising:

an outer housing;

an inner mandrel movable relative to the outer housing; and a packing element actuatable by the relative movement between the outer housing and the inner mandrel, wherein the inner mandrel includes a first piston surface opposed to a second piston surface to prevent relative movement between the outer housing and the inner mandrel in response to fluid pressure, wherein a surface area of the first piston surface is provided to move the inner mandrel relative to the outer housing in a first direction and a surface area of the second piston surface is provided to move the inner mandrel relative to the outer housing in a second direction, and wherein the surface areas of the first and second piston surfaces are effectively equivalent to prevent relative movement between the outer housing and the inner mandrel in response to fluid pressure.

2. The packer of claim 1, further comprising a biasing member configured to bias the inner mandrel relative to the outer housing along a longitudinal axis.

3. The packer of claim 2, wherein the packer is actuated by using a mechanical force applied to overcome resistance from the biasing member.

4. The packer of claim 2, wherein in the biasing member biases the inner mandrel against the outer housing.

5. The packer of claim 1, wherein the packer includes a debris barrier formed by an interface between two components.

6. The packer of claim 1, wherein the inner mandrel is moved relative to the outer housing by applying a tension force.

7. The packer of claim 1, wherein the inner mandrel is pressure balanced by an equalization of pressure acting on the inner mandrel.

8. The packer of claim 1, wherein the surface areas of the first and second piston surfaces provide an effective zero net fluid force acting on the inner mandrel in response to the fluid pressure.

9. A method of conducting a wellbore operation, comprising:

lowering an assembly, wherein the assembly includes a first packer and a second packer;

actuating at least the first packer into a set position; and pressure balancing a first piston surface opposed to a second piston surface to provide an effective zero net fluid force acting on at least the first packer in response to the fluid pressure.

10. The method of claim 9, wherein the second packer is actuated before the first packer.

11. The method of claim 9, wherein the first and second piston surfaces are disposed on a mandrel in at least the first packer.

12. The method of claim 9, wherein the assembly includes an anchor.

13. The method of claim 12, further comprising actuating the anchor by applying a mechanical force to the assembly.

14. The method of claim 9, wherein the assembly includes an injection port disposed between the first packer and the second packer.

15. The method of claim 14, further comprising locating the injection port adjacent an area of interest in a wellbore.

16. The method of claim 15, further comprising flowing a fluid into the area of interest via the injection port.

17. The method of claim 9, wherein actuating at least the first packer includes applying a mechanical force to the assembly to secure engagement with the wellbore.

18. The method of claim 17, wherein the first packer is actuated using a higher, mechanical force than the second packer.

19. The method of claim 17, further comprising releasing the mechanical force being applied to the assembly to release the assembly from secured engagement with the wellbore.

20. The method of claim 9, wherein the first packer is an upper packer and the second packer is a lower packer.

21. The method of claim 9, wherein the first packer is a lower packer and the second packer is an upper packer.

22. An assembly for conducting a treatment operation in a wellbore, comprising:

a first packer;

a second packer, wherein the second packer is actuatable to seal an area of interest in the wellbore and the second packer is pressure balanced to provide an effective zero net fluid force acting on the second packer in response to fluid pressure;

an injection port disposed between the first and second packers for injecting a treatment fluid into the area of interest; and an anchor for securing the assembly in the wellbore.

23. The assembly of claim 22, wherein the first packer is a mechanically set packer.

24. The assembly of claim 22, wherein the first packer is a hydraulic set packer.

25. The assembly of claim 22, wherein the first packer comprises an anchor equipped with a packing element.

26. The assembly of claim 22, wherein the second packer includes a debris barrier formed by an interface between two components.

27. The assembly of claim 22, wherein the first packer is oriented in an upside down direction relative to the second packer.

28. The assembly of claim 22, wherein the second packer includes:

an outer housing;

an inner mandrel movable relative to the outer housing; and a packing element actuatable by the relative movement between the outer housing and the inner mandrel, wherein the inner mandrel is pressure balanced to prevent relative movement between the outer housing and the inner mandrel in response to hydraulic pressure.

29. The packer of claim 28, wherein the second packer further comprises a biasing member configured to bias the inner mandrel relative to the outer housing along a longitudinal axis.

30. The packer of claim 29, wherein the second packer is actuated by using a mechanical force applied to overcome resistance from the biasing member.

31. The packer of claim 29, wherein in the biasing member biases the inner mandrel against the outer housing.

32. The packer of claim 28, wherein the inner mandrel is moved relative to the outer housing by applying a tension force.

33. The assembly of claim 22, wherein the second packer is pressure balanced by an equalization of pressure forces in the second packer.

34. The assembly of claim 22, wherein the second packer is actuatable using a mechanical force.

35. A method of conducting a wellbore operation, comprising:

lowering an assembly, wherein the assembly includes a first packer and a second packer;

actuating at least the first packer into a set state;

exposing two opposing effectively equivalent piston areas of at least the first packer to a fluid pressure to prevent changing at least the first packer from the set state in response to the fluid pressure and pressure balancing the two piston areas.

36. The method of claim 35, wherein the first packer is an upper packer and the second packer is a lower packer.

37. The method of claim 35, wherein the first packer is a lower packer and the second packer is an upper packer.

38. The method of claim 35, wherein the two opposing piston areas of at least the first packer provide an effective zero net fluid force acting on at least the first packer in response to the fluid pressure.

* * * * *